US007192112B2

(12) United States Patent
Nakanishi et al.

(10) Patent No.: US 7,192,112 B2
(45) Date of Patent: Mar. 20, 2007

(54) PRINTING APPARATUS AND METHOD CAPABLE OF COMPLEMENTARY PRINTING FOR AN INK DISCHARGE FAILURE NOZZLE

(75) Inventors: Hideki Nakanishi, Kanagawa (JP); Kazuhisa Kuruma, Kanagawa (JP); Takayuki Murata, Kanagawa (JP); Yuichiro Suzuki, Kanagawa (JP); Hitoshi Nishikori, Tokyo (JP); Masao Maeda, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 435 days.

(21) Appl. No.: 10/929,513

(22) Filed: Aug. 31, 2004

(65) Prior Publication Data

US 2005/0083360 A1 Apr. 21, 2005

(30) Foreign Application Priority Data

Sep. 3, 2003 (JP) ..... 2003-311342

(51) Int. Cl.
*B41J 29/38* (2006.01)

(52) U.S. Cl. ..... 347/14; 347/5; 347/9; 347/10; 347/12; 347/19

(58) Field of Classification Search ..... 347/14
See application file for complete search history.

(56) References Cited

U.S. PATENT DOCUMENTS

| | | | |
|---|---|---|---|
| 4,313,124 | A | 1/1982 | Hara |
| 4,345,262 | A | 8/1982 | Shirato et al. |
| 4,463,359 | A | 7/1984 | Ayata et al. |
| 6,089,695 | A | 7/2000 | Takagi et al. |
| 6,168,261 | B1 | 1/2001 | Miyake et al. |
| 6,174,039 | B1 | 1/2001 | Miyake et al. |
| 6,203,140 | B1 | 3/2001 | Oyen |
| 6,270,187 | B1 | 8/2001 | Murcia et al. |
| 6,347,855 | B1 | 2/2002 | Takanaka |
| 6,428,139 | B1 | 8/2002 | Silverbrook |

(Continued)

FOREIGN PATENT DOCUMENTS

| | | |
|---|---|---|
| JP | 6-79956 | 3/1994 |

(Continued)

*Primary Examiner*—Stephen Meier
*Assistant Examiner*—Brian J. Goldberg
(74) *Attorney, Agent, or Firm*—Fitzpatrick, Cella, Harper & Scinto

(57) ABSTRACT

Disclosed are a printing apparatus and printing method which suppress degradation of the image quality caused by discharge failure complement. In the printing apparatus, virtual data are generated for predetermined dots in a scanning direction on the basis of printing data of a plurality of dots in the scanning direction of an inkjet printhead that are printed by an ink discharge failure nozzle among a plurality of nozzles. The priorities of dots subjected to complementary printing among a plurality of dots within a predetermined adjacent area where the printing data and virtual data are printed are decided on the basis of the printing data and virtual data. A position subjected to complementary printing is decided on the basis of the priorities, printing data, and virtual data. Printing data and virtual data which actually cause ink discharge are so moved as to print at the position. Corrected printing data to be actually printed is generated on the basis of the moved data. Printing is performed by driving the inkjet printhead on the basis of the corrected printing data.

13 Claims, 15 Drawing Sheets

U.S. PATENT DOCUMENTS

| | | | | |
|---|---|---|---|---|
| 6,450,613 | B1 | 9/2002 | Rietbergen | |
| 6,481,816 | B1 * | 11/2002 | Oyen | 347/12 |
| 6,513,895 | B2 | 2/2003 | Bauer et al. | |
| 6,520,623 | B2 | 2/2003 | Miyake et al. | |
| 6,659,580 | B2 | 12/2003 | Horikoshi | |
| 2002/0021325 | A1 | 2/2002 | Koitabashi et al. | |
| 2003/0085949 | A1 | 5/2003 | Koitabashi et al. | |
| 2004/0119766 | A1 | 6/2004 | Shibata et al. | |

FOREIGN PATENT DOCUMENTS

| | | |
|---|---|---|
| JP | 6-226982 | 8/1994 |
| JP | 8-25700 | 1/1996 |
| JP | 9-174824 | 7/1997 |
| JP | 11-77986 | 3/1999 |
| JP | 2000-94662 | 4/2000 |
| JP | 2002-19101 | 1/2002 |
| JP | 2003-205604 | 7/2003 |

* cited by examiner

FIG. 2B

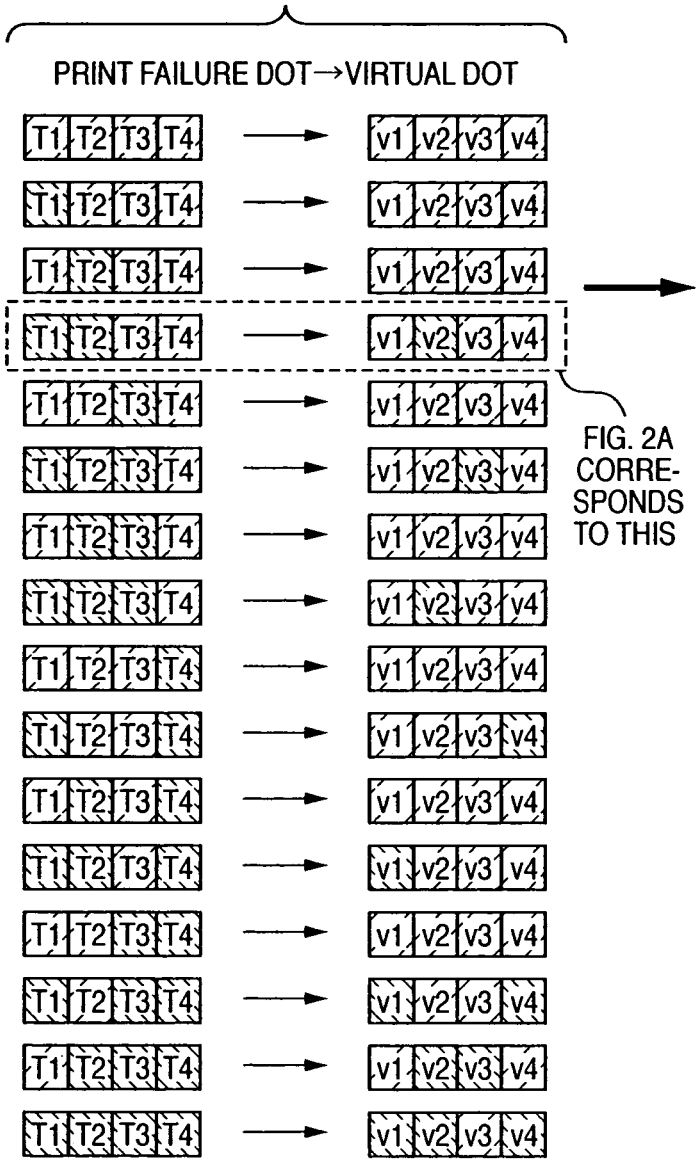

FIG. 2C

```
always(
  inp,
  table0, table1, table2, table3,
  table4, table5, table6, table7,
  table8, table9, table10, table11,
  table12, table13, table14, table15,
)begin
  case inp
    4'b0000:outp = table0;
    4'b0001:outp = table1;
    4'b0010:outp = table2;
    4'b0011:outp = table3;
    4'b0100:outp = table4;
    4'b0101:outp = table5;
    4'b0110:outp = table6;
    4'b0111:outp = table7;
    4'b1000:outp = table8;
    4'b1001:outp = table9;
    4'b1010:outp = table10;
    4'b1011:outp = table11;
    4'b1100:outp = table12;
    4'b1101:outp = table13;
    4'b1110:outp = table14;
    default:outp = table15;
  endcase
end
```

verilog-HDL DESCRIPTION EXAMPLE IN ORDER TO GIVE FLEXIBILITY, table0 TO table15 ARE OF reg TYPE, AND THEIR VALUES ARE DESIRABLY SET CHANGEABLE.

FIG. 3B

PRIORITY IS ASSIGNED.

| | | | |
|---|---|---|---|
| 1 | 2 | 3 | 4 |
| 5 | 6 | 7 | 8 |
| T1 | | | |
| 9 | 10 | 11 | 12 |
| 13 | 14 | 15 | 16 |

T1 COMPLEMENT PRIORITY

| | | | |
|---|---|---|---|
| 9 | 10 | 11 | 12 |
| 13 | 14 | 15 | 16 |
| | T2 | | |
| 1 | 2 | 3 | 4 |
| 5 | 6 | 7 | 8 |

T2 COMPLEMENT PRIORITY

| | | | |
|---|---|---|---|
| 13 | 14 | 15 | 16 |
| 9 | 10 | 11 | 12 |
| | | T3 | |
| 5 | 6 | 7 | 8 |
| 1 | 2 | 3 | 4 |

T3 COMPLEMENT PRIORITY

| | | | |
|---|---|---|---|
| 5 | 6 | 7 | 8 |
| 1 | 2 | 3 | 4 |
| | | | T4 |
| 13 | 14 | 15 | 16 |
| 9 | 10 | 11 | 12 |

T4 COMPLEMENT PRIORITY

| | | | |
|---|---|---|---|
| 1 | 5 | 9 | 13 |
| 2 | 6 | 10 | 14 |
| | | | v1 |
| 3 | 7 | 11 | 15 |
| 4 | 8 | 12 | 16 |

v1 COMPLEMENT PRIORITY

| | | | |
|---|---|---|---|
| 5 | 1 | 13 | 9 |
| 6 | 2 | 14 | 10 |
| | | | v2 |
| 7 | 3 | 15 | 11 |
| 8 | 4 | 16 | 12 |

v2 COMPLEMENT PRIORITY

| | | | |
|---|---|---|---|
| 9 | 5 | 1 | 13 |
| 10 | 6 | 2 | 14 |
| | | | v3 |
| 11 | 7 | 3 | 15 |
| 12 | 8 | 4 | 16 |

v3 COMPLEMENT PRIORITY

| | | | |
|---|---|---|---|
| 13 | 9 | 5 | 1 |
| 14 | 10 | 6 | 2 |
| | | | v4 |
| 15 | 11 | 7 | 3 |
| 16 | 12 | 8 | 4 |

v4 COMPLEMENT PRIORITY

PRINTING APPARATUS AND METHOD CAPABLE OF COMPLEMENTARY PRINTING FOR AN INK DISCHARGE FAILURE NOZZLE

FIELD OF THE INVENTION

This invention relates to a printing apparatus and printing method and, more particularly, to a printing apparatus to which an inkjet printhead is mounted, and a printing method.

BACKGROUND OF THE INVENTION

In printing by a printer using an ink-jet printhead (to be referred to as a printhead hereinafter) having a plurality of nozzles, if the printhead includes even one ink discharge failure nozzle (to be referred to as a discharge failure nozzle hereinafter), a white stripe appears on a printed product, and the printed product cannot be used duly. When even one discharge failure nozzle exists in the printhead and the discharge failure occurs due to a cause which cannot be solved even by a recovery process, there is no means for solving this printing failure except that the printhead having the discharge failure nozzle is not used.

More specifically, when an unrecoverable discharge failure nozzle is detected during printhead manufacturing process, the printhead having the discharge failure nozzle must be discarded. If a discharge failure nozzle unrecoverable by the recovery process is detected in the printhead after the printhead is passed to the user, the user must exchange the printhead.

Not only a discharge failure nozzle, but also a nozzle which cannot correctly print due to a discharge direction greatly deviated from a normal direction, and a nozzle which negatively influences printing because the size of a discharged ink droplet is greatly different from a normal one are not suitable for normal printing. These nozzles are treated as abnormal nozzles, similar to the discharge failure nozzle. A printhead having such abnormal nozzle is regarded as a defective printhead.

Occurrence of a discharge failure nozzle (to be also referred to as an abnormal nozzle hereinafter) in the printhead imposes an economic burden on both the manufacturer and user.

Recent printheads are equipped with a large number of ink discharge nozzles (to be referred to as nozzles hereinafter). For example, assuming that the printhead has 512 nozzles in order to discharge an ink of one color, a printhead designed to discharge inks of six different colors has a total of 3,072 nozzles. As the number of nozzles increases, the possibility at which discharge failure nozzles occur increases. Demands have arisen for a measure against a discharge failure nozzle so as to reduce the economic burden on both the manufacturer and user.

In order to avoid this situation, several printer manufacturers have recently proposed a technique associated with so-called discharge failure complement of complementing printing of a discharge failure nozzle in the printhead. For example, Japanese Patent Publication Laid Open No. 6-226982 discloses a technique in which when a discharge failure nozzle exists in the printhead, printing data corresponding to the position of the discharge failure nozzle is printed by a normal nozzle.

Assume that complementary printing is performed by, e.g., multi-pass printing with a normal nozzle using printing data corresponding to the position of a discharge failure nozzle. In multi-pass printing, a printing medium is generally conveyed by a width obtained by dividing the printing width of the printhead by the number of passes of multi-pass printing every time printing by one scanning is completed.

More specifically, when the printhead has 512 nozzles and performs printing which is completed by four passes, the sheet feed amount after one scanning in the main scanning direction is almost equal to a printhead printing width of 512÷4=128 nozzles. At this time, the same raster on the sheet surface is always printed by different nozzles of the printhead in respective passes. In an example in which the printhead has 512 nozzles and performs 4-pass printing, a raster printed by the first nozzle counted from the uppermost end of the printhead in the first pass shifts by 128 nozzles in the second pass, and is identical to a raster printed by the 129th nozzle counted from the uppermost end of the printhead. From this principle, when the first nozzle counted from the uppermost end of the printhead is a discharge failure nozzle, data to be printed by the first nozzle is printed by the 129th nozzle counted from the uppermost end of the printhead in the second pass. In this manner, printing can be achieved by complementing the discharge failure of the first nozzle.

Also in single-pass printing, a discharge failure can be complemented in principle by setting a discharge failure complement printing pass in addition to a normal printing pass.

When the first nozzle counted from the uppermost end of the printhead is a discharge failure nozzle in a printhead having 512 nozzles, similar to the above-described example, single-pass printing is normally executed in the first pass. The sheet is then conveyed by a printhead printing width of 128 nozzles, and the 129th nozzle counted from the upper end of the printhead prints printing data which should be used by the first nozzle serving as a discharge failure nozzle. At this time, no printing is done by another nozzle, thereby implementing complement of a discharge failure.

There is also known an arrangement in which nozzles other than a discharge failure nozzle print in scanning a carriage in the forward direction, then the sheet is slightly conveyed, and another nozzle prints in an area not printed due to a discharge failure in scanning the carriage in the backward direction (see, e.g., Japanese Patent Publication Laid Open No. 8-25700).

To complement a discharge failure by the conventional method, the carriage must be scanned at least twice in the scanning direction.

As another discharge failure complement method, for example, Japanese Patent Publication Laid Open No. 2002-19101 discloses a method of performing complement in the same scanning using a nozzle used for discharging another color ink, and a method of increasing the printing duty of a nozzle adjacent to a discharge failure nozzle thereby complementing a part which is not printed owing to a discharge failure.

However, such a conventional discharge failure complement technique poses the following problems and is rarely employed.

Multi-pass printing will be considered first.

One of printing methods often adopted in current printers is "margin-less printing". In this printing mode, when the printing paper size is, e.g., A4 size, printing is done on the entire sheet surface of this size. Generally in this printing at portions (in the sub-scanning direction) corresponding to the upper and lower margins of a paper sheet, the sheet conveyance amount changes even in the use of the same multi-pass printing method. For example, in 4-pass printing using a printhead having 512 nozzles, the sheet conveyance amount is almost equal to a printhead printing width of 128 nozzles, as described above. At portions corresponding to the upper and lower marginal areas of a paper sheet, printing is done using not all the 512 nozzles, but only some nozzles, e.g., 128 nozzles. At this time, the sheet conveyance amount is 128÷4=32 nozzles.

In this case, a raster printed by the first nozzle counted from the upper end of the printhead shifts by 32 nozzles in the second pass, and is identical to a raster printed by the 33rd nozzle counted from the upper end of the printhead. This means that the position of a target nozzle to be complemented dynamically changes on the same printing sheet surface, unlike a case where, when the first nozzle counted from the uppermost end of the printhead is a discharge failure nozzle, similar to the above-described example, it is unconditionally decided that printing data corresponding to the discharge failure nozzle can be complemented by the 129th nozzle counted from the uppermost end of the printhead.

It is a heavy burden on a conventional printing system to process in real time to a certain degree the relationship between a discharge failure nozzle and a complementary nozzle that dynamically changes. In the use of a printhead in which 512 nozzles are arranged in six arrays in the scanning direction of the printhead in order to cope with printing using inks of six different colors, a discharge failure cannot be complemented in practice if discharge failure nozzles occur at different positions of the nozzle arrays.

Discharge failure complement in the above-mentioned single-pass printing requires redundant scanning in the main scanning direction for only the complement process, which decreases the printing speed.

As a method of solving this problem, there is proposed a method of completing discharge failure complement by only one scanning of the printhead without utilizing discharge failure complement by multi-pass printing (see, e.g., Japanese Patent Publication Laid Open No. 2002-19101).

According to this method, when a discharge failure nozzle exists in the printhead, printing data assigned to this nozzle is distributed to a normal printing nozzle of the same nozzle array that exists near the discharge failure nozzle. This method can eliminate the need for a complicated data process over multiple passes even in discharge failure complement. No printing pass for only discharge failure complement exists, and a high-speed process can be easily achieved at a relatively low cost.

However, the conventional technique of completing discharge failure complement by only one scanning of the printhead suffers the following problems.

That is, the method of distributing printing data assigned to a discharge failure nozzle to a normal printing nozzle of the same nozzle array that exists near the discharge failure nozzle cannot avoid in principle a phenomenon in which a dot is printed at a position slightly deviated from an originally assigned position on the sheet surface. Especially in an image with a gradation of light colors, a white stripe might appear at a position (i.e., a discharge failure-complemented raster) where the printing raster of the discharge failure nozzle should exist.

Assume that the printhead has 512 nozzles and these nozzles are regularly arranged at an interval of 1,200 dpi. In this case, the presence of one discharge failure nozzle in the nozzle array means that one of print dots which should be regularly arranged at an interval of 1,200 dpi in the printed image is not printed. As a result, a white stripe is formed at a width of 1,200 dpi in the printed image. When the above-described conventional method of completing discharge failure complement by only one scanning of the printhead is applied, even complementary printing may not completely complement the 1,200-dpi wide white stripe by moving one print dot assigned to the discharge failure nozzle to a normal nozzle of the same nozzle array that exists near the discharge failure nozzle.

In multi-pass printing (e.g., 4-pass printing or 8-pass printing) completed by many passes, the number of dots printed by one scanning of the printhead is small. For a smaller number of dots printed by one scanning, the number of print dots assigned to a discharge failure nozzle becomes smaller, and the complement count in one raster also becomes smaller. This makes the 1,200-dpi wide white stripe less conspicuous. To the contrary, in 2-pass printing or single-pass printing, the number of dots printed by one scanning is relatively large, and the white stripe still stands out.

As described above, the image quality inevitably degrades in the conventional method of completing discharge failure complement by one scanning of the printhead.

SUMMARY OF THE INVENTION

Accordingly, the present invention is conceived as a response to the above-described disadvantages of the conventional art.

For example, a printing apparatus and printing method according to the present invention is capable of suppressing degradation of the image quality caused by discharge failure complement.

According to one aspect of the present invention, preferably, there is provided a printing apparatus which prints by using an inkjet printhead having a nozzle array formed from a plurality of nozzles for discharging ink, comprising: scanning means for scanning the inkjet printhead in a direction different from a direction of the nozzle array; virtual data generation means for generating virtual data over one more dots in the scanning direction on the basis of printing data of a plurality of dots in the scanning direction that are printed by an ink discharge failure nozzle among the plurality of nozzles; decision means for deciding a position subjected to complementary printing on the basis of a priority of a dot to be complementary-printed, the printing data of the plurality of dots, and the virtual data; moving means for moving printing data and virtual data which actually cause ink discharge so as to print at the complementary printing position decided by the decision means; corrected printing data generation means for generating corrected printing data to be actually printed by the inkjet printhead on the basis of the printing data and the virtual data which are moved by the moving means; and printing means for printing by driving the inkjet printhead on the basis of the corrected printing data generated by the corrected printing data generation means, wherein the priority is obtained from the printing data of the plurality of dots and the virtual data, and the priority is a priority determined in a plurality of dots included in a predetermined adjacent area where the printing data of the plurality of dots and the virtual data are printed.

The apparatus preferably further comprises priority decision means for deciding priorities of dots subjected to complementary printing among a plurality of dots within a predetermined adjacent area where the printing data of the plurality of dots and the virtual data are printed on the basis of the printing data of the plurality of dots and the virtual data, wherein the decision means decides a position where complementary printing should be performed, on the basis of the priority decided by the priority decision means.

The virtual data generation means desirably has a table for generating the virtual data from the printing data of the plurality of dots.

The predetermined adjacent area subjected to complementary printing desirably includes an area surrounded by a plurality of dots in the scanning direction of the inkjet printhead and a plurality of dots of the nozzle array that surround the ink discharge failure nozzle.

The priority decision means desirably has priority data which defines priorities of dots subjected to complementary printing for dots corresponding to the printing data of the plurality of dots and the virtual data.

The virtual data generation means, the priority decision means, the decision means, the moving means, and the corrected printing data generation means are desirably formed by an ASIC.

The inkjet printhead may comprise a plurality of nozzle arrays in correspondence with a plurality of different inks.

When the inkjet printhead having a plurality of nozzle arrays is adopted, the printing apparatus desirably further comprises a memory which stores priority data defining priorities of dots subjected to complementary printing, and tables for generating virtual data, the priority data and the tables corresponding to the plurality of nozzle arrays. The printing apparatus desirably further comprises control means for reading out the priority data and the table that correspond to a nozzle array used to discharge ink, from the memory at each timing at which a nozzle array for discharging ink changes among the plurality of nozzle arrays.

According to another aspect of the present invention, preferably, there is provided a printing method capable of complementary printing when there is an ink discharge failure nozzle in an inkjet printhead having a nozzle array formed from a plurality of nozzles for discharging ink, comprising: a virtual data generation step of generating virtual data over one or more dots in a scanning direction on the basis of printing data of a plurality of dots in a scanning direction of the inkjet printhead that are printed by an ink discharge failure nozzle among the plurality of nozzles; a decision step of deciding a position subjected to complementary printing on the basis of a priority of a dot to be complementary-printed, the printing data of the plurality of dots, and the virtual data; a moving step of moving printing data and virtual data which actually cause ink discharge so as to print at the complementary printing position decided at the decision step; a corrected printing data generation step of generating corrected printing data to be actually printed by the inkjet printhead on the basis of the printing data and the virtual data which are moved at the moving step; and a printing step of printing by driving the inkjet printhead on the basis of the corrected printing data generated at the corrected printing data generation step, wherein the priority is obtained from the printing data of the plurality of dots and the virtual data, and the priority is a priority determined in a plurality of dots included in a predetermined adjacent area where the printing data of the plurality of dots and the virtual data are printed.

The method preferably further comprises a priority decision step of deciding priorities of dots subjected to complementary printing among a plurality of dots within a predetermined adjacent area where the printing data of the plurality of dots and the virtual data are printed on the basis of the printing data of the plurality of dots and the virtual data, wherein, at the decision step, a position where complementary printing should be performed is decided on the basis of the priority decided at the priority decision means.

According to still another aspect of the present invention, preferably, there is provided a program which allows a computer to execute steps of the above method.

According to still another aspect of the present invention, preferably, there is provided a computer-readable storage medium which stores the program.

The invention is particularly advantageous since the concept "virtual dot area" is introduced to intentionally extend a print dot which should be printed by an ink discharge failure nozzle, and complementarily print the extended print dot by using dots in the adjacent area. Complementary printing is performed using a larger number of dots, and higher-quality complementary printing can be implemented by suppressing degradation of the image quality which is caused by complementary printing and stands out in a conventional discharge failure complement method.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

FIGS. 2A, 2B, and 2C are views simply expressing the principle of discharge failure complement;

FIGS. 3A and 3B are views for explaining involvement of dots within the virtual dot area in discharge failure complement;

DETAILED DESCRIPTION OF THE PREFERRED EMBODIMENTS

Preferred embodiments of the present invention will now be described in detail in accordance with the accompanying drawings.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink (e.g., can solidify or insolubilize a coloring agent contained in ink applied to the print medium).

Furthermore, unless otherwise stated, the term "nozzle" generally means a set of a discharge orifice, a liquid channel connected to the orifice and an element to generate energy utilized for ink discharge.

In the following embodiments, abnormal nozzles or discharge failure nozzles include not only a nozzle which fails in discharge, but also a nozzle in which the discharge direction or the size of a discharged ink droplet is greatly different from that of a normal nozzle.

A principle necessary to implement the present invention will be explained first.

1. Principle

Figure 1:
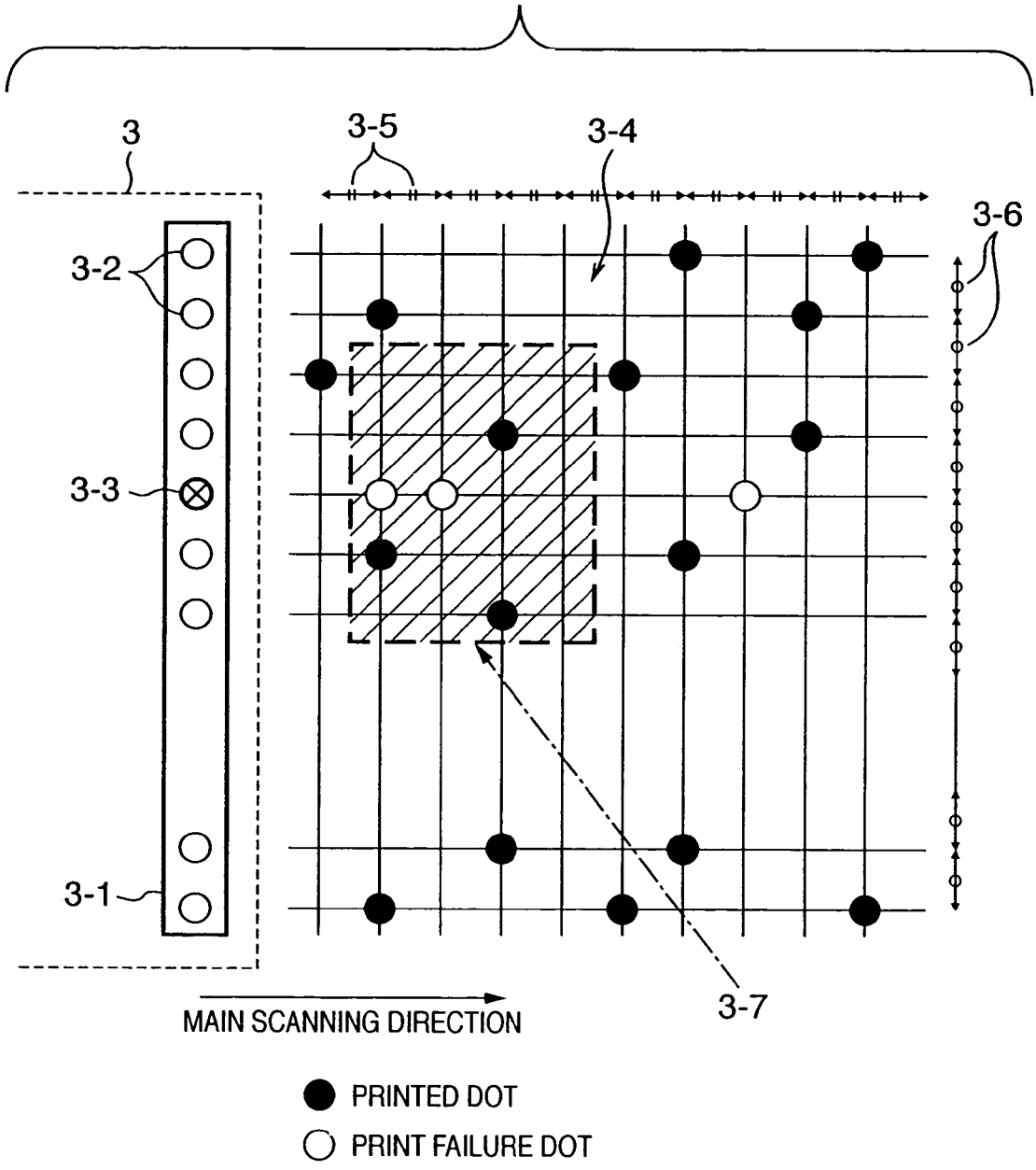
FIG. 1 is a view schematically showing a printing state in the presence of a discharge failure nozzle.

FIG. 1 is a view schematically showing a printing state in the presence of a discharge failure nozzle.

FIG. 1 illustrates a specific nozzle array 3-1 extracted from a printhead 3. This nozzle array includes (many) normal nozzles 3-2 and a discharge failure nozzle 3-3 (in this example, only one discharge failure nozzle exists in the nozzle array 3-1), as shown in FIG. 1. Reference numeral 3-4 denotes a printed image which is formed on a printing medium by the nozzle array 3-1 of the printhead 3. At this time, the printhead 3 prints an image while moving in the main scanning direction.

Further, the ink discharge timing of the printhead 3 is determined, and the nozzle array 3-1 of the printhead 3 forms the printed image 3-4 while maintaining a specified interval (i.e., a column interval 3-5) in the main scanning direction and a specified interval (i.e., a raster interval 3-6 which generally complies with the mechanical interval of the nozzle array 3-1) in a direction perpendicular to the main scanning direction. The printed image 3-4 shown in FIG. 1 is an image printed when the printhead 3 scans once in the main scanning direction. In other words, the printed image 3-4 is not a printed image upon the completion of multi-pass printing.

In this case, the normal nozzle 3-2 discharges ink to a position "●" in the printed image 3-4 ("●" will be referred to as a printed dot hereinafter). The discharge failure nozzle 3-3 should originally discharge ink to a position "○", but does not discharge any ink to this position ("○" will be referred to as a print failure dot hereinafter).

The purpose of this embodiment is to perform discharge failure complement at the position "○" without degrading the image quality.

Discharge failure complement exemplified in this embodiment assumes that the process is executed within a printing area (to be referred to as a complement target area hereinafter) defined by two upper nozzles and two lower nozzles of a discharge failure nozzle and four columns in the main scanning direction. For descriptive convenience, a case where a print failure dot within a complement target area 3-7 is complemented will be explained by using only the area 3-7.

Figure 2A:
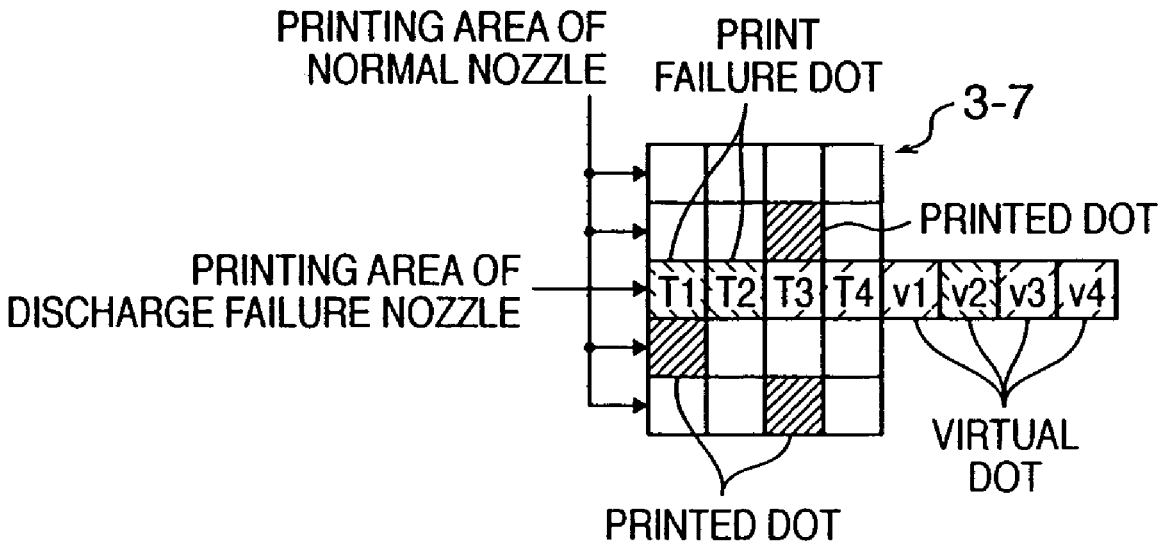

FIGS. 2A to 2C are views simply representing the principle of discharge failure complement.

FIG. 2A is a view showing the extracted complement target area 3-7 in FIG. 1. The complement target area 3-7 contains three printed dots "●" and two print failure dots "○". For descriptive convenience, the positions of print failure dots on respective columns will be called T1, T2, T3, and T4 from the left dot ("T" is the initial letter of a target for discharge failure complement).

In the prior art, if one dot to be printed exists at the position of a discharge failure nozzle, the dot is moved to one of the printing positions of normal nozzles (to a position at which the normal nozzle does not have any printing data). In FIG. 1 or 2A, two dots are not printed due to a discharge failure. According to the prior art, while avoiding three printed dots which originally exist, the two dots are complementarily printed within the printing area of any normal nozzle in FIG. 2A.

To the contrary, this embodiment executes the following process.

Assume that a discharge failure nozzle has a virtual dot area (in the example, four columns=four dots) as shown in FIG. 2A outside a printing area of four columns. The virtual dot area does not exist in the printing medium space, and data of the virtual dot area does not exist in a so-called print buffer of the printing apparatus. The virtual dot area is a virtual printing data area which exists in a discharge failure complement process according to the embodiment. For descriptive convenience, the positions of four virtual dots will be called v1, v2, v3, and v4 from the left dot ("v" is the initial letter of "virtual").

How to generate the virtual dot area will be explained with reference to FIG. 2B. The virtual dot area pattern is determined depending on the type of printing pattern present at the positions of discharge failure dots of four columns. For example, the printing pattern of discharge failure dots shown in FIG. 2A corresponds to a pattern surrounded by the broken line.

A conceivable example of the circuit configuration at this portion is a logical configuration as shown in FIG. 2C. Briefly, in FIG. 2C, "inp" (4-bit signal) represents a printing pattern of discharge failure dots of four columns, "outp" (4-bit signal) represents a virtual dot pattern of four dots generated from the printing pattern "inp", and "table0" to "table15" (4-bit signals, respectively) represent virtual dot generation tables showing how a virtual dot pattern of four dots is provided for the printing pattern of discharge failure dots of four columns. The table is desirably designed changeable by firmware.

By using the logical circuit as shown in FIG. 2C, the number of printed dots for discharge failure dots can be increased within the virtual dot area. The number of dots is four at maximum in this embodiment. However, as described above, the virtual dot area does not exist in the space of a printing medium (e.g., the sheet surface of a printing sheet), and no dot is printed without any process.

Next, involvement of dots within the virtual dot area in discharge failure complement will be explained with reference to FIGS. 3A to 5. A discharge failure complement method employed in this embodiment will also be described.

Figure 3A:
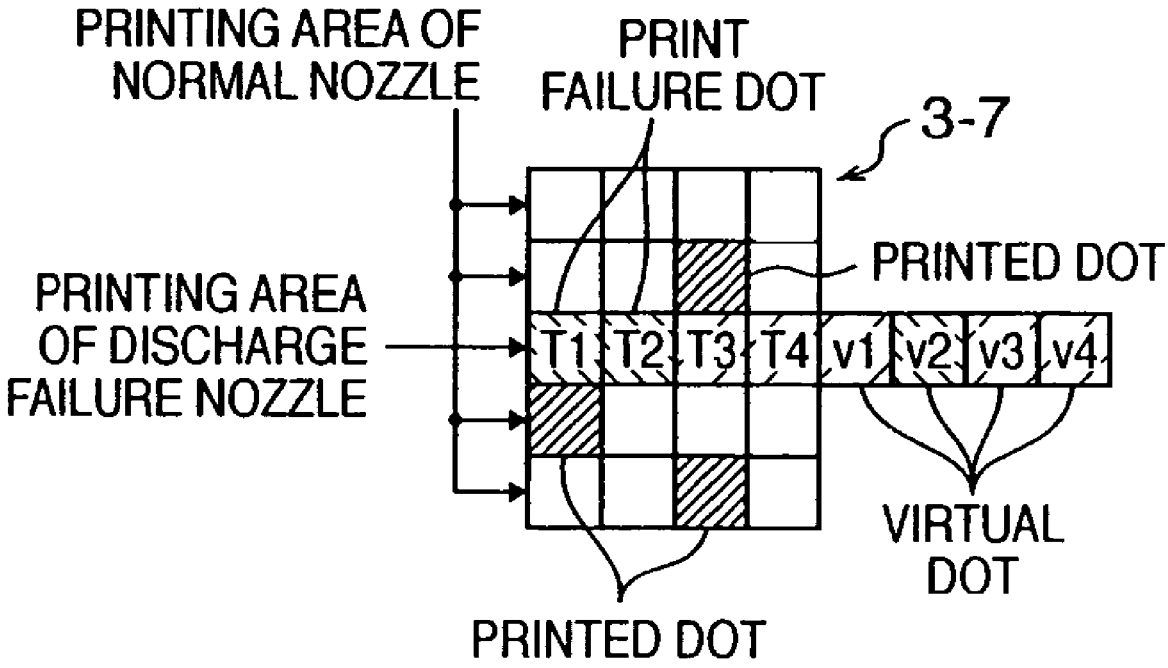

FIG. 3A is a view showing a state after the complement target area 3-7 as one of complement target areas shown in FIG. 1 undergoes the virtual dot generation process shown in FIGS. 2A to 2C. The complement target area 3-7 includes three printed dots, two print failure dots, and one virtual dot which is generated by the above process.

FIG. 3B is a view showing states in which priorities for complementing print failure dots are assigned to printable dot positions at which not a discharge failure nozzle but a normal printing nozzle exists, other than the positions of print failure dots, in order to complement print failure dots shown in FIG. 3A. In FIG. 3B, the printing area of a discharge failure nozzle includes four dots, the virtual dot area includes four dots, and thus a total of eight dots exist. Hence, there are eight patterns as shown in FIG. 3B.

In this stage, priority numbers are assigned regardless of whether or not a dot to be printed exists at a dot position to be assigned a priority. Different priorities are assigned to discharge failure dots T1, T2, T3, and T4 and virtual dots v1, v2, v3, and v4. Since 16 dot positions are subjected to discharge failure complement, discharge failure complement priorities are assigned to eight patterns by numbers "1" to "16", as shown in FIG. 3B. These priorities may be assigned to T1, T2, T3, T4, v1, v2, v3, and v4 by the same pattern. However, considering the image quality, the priorities are desirably assigned by different patterns, as shown in FIG. 3B.

Figure 4:
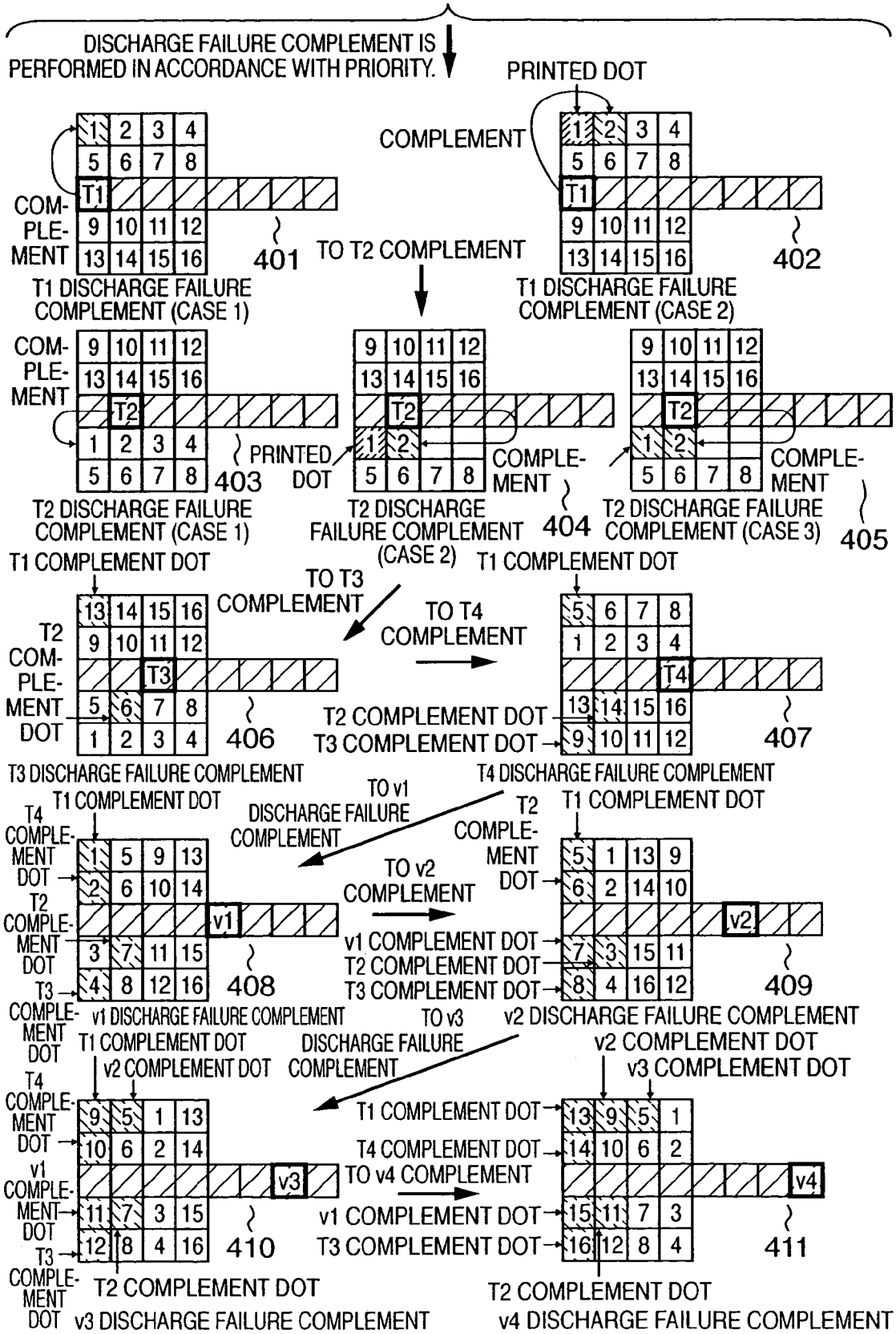
FIG. 4 is a view for explaining involvement of dots within the virtual dot area in discharge failure complement.

FIG. 4 shows states in which discharge failure dots are complemented in accordance with the discharge failure complement priorities assigned as shown in FIG. 3B. In FIG. 4, the positions of printed dots in the complement target area 3-7 are not fixed, unlike FIG. 3A. FIG. 4 illustrates how to perform discharge failure complement for T1, T2, T3, T4, v1, v2, v3, and v4 in some cases.

A case in which a printed dot exists at the position of the print failure dot T1 will be explained.

T1 discharge failure complement (case 1) 401 in FIG. 4 is an example of this case. In case 1, "0" printed dot and one print failure dot which has not been printed due to a discharge failure exist. In this case, one print failure dot simply shifts to a position of the highest discharge failure complement priority (i.e., dot complement is executed). In 401 of FIG. 4, this position is a dot position having discharge failure complement priority "1".

T1 discharge failure complement (case 2) 402 will be examined. In case 2, one printed dot and one print failure dot which has not been printed due to a discharge failure exist. In this case, one printed dot exists at a position having discharge failure complement priority "1". The print failure dot shifts to a position of the second highest discharge failure complement priority. In 402 of FIG. 4, this position is a dot position having discharge failure complement priority "2".

A case in which a printed dot exists at the position of the print failure dot T2 will be described.

Assume that the T2 discharge failure complement process must be performed after the end of the T1 process in consideration of the scanning direction of the printhead as shown in FIG. 1. T2 discharge failure complement (case 1) 403 is an example of this case. In case 1, no printed dot and one print failure dot which has not been printed due to a discharge failure exist. In this case, the print failure dot is simply complemented at a position of the highest discharge failure complement priority. In 403 of FIG. 4, this position is a dot position having discharge failure complement priority "1".

T2 discharge failure complement (case 2) 404 will be examined. In case 2, one printed dot and one print failure dot which has not been printed due to a discharge failure exist. In this case, one printed dot exists at a position having discharge failure complement priority "1". The print failure dot shifts to a position of the second highest discharge failure complement priority. In 404 of FIG. 4, this position is a dot position having discharge failure complement priority "2".

T2 discharge failure complement (case 3) 405 will be examined. In case 3, one printed dot and one complement dot (assumed to have been generated in the T1 process preceding to the T2 process) exist. The complement dot exists at a position having discharge failure complement priority "1". In this case, the print failure dot shifts to a position of the second highest discharge failure complement priority. In 405 of FIG. 4, this position is a dot position having discharge failure complement priority "2".

In this manner, the discharge failure complement process is executed in order of T1→T2, and then the process is executed by the same algorithm in order of T3→T4. This will be explained briefly.

In T3 discharge failure complement 406 of FIG. 4, if a printed dot exists at the position of dot T3, the complement process is done using a dot except complement dots formed at T1 and T2 and original printed dots. In 406 of FIG. 4, complement is performed at a position having discharge failure complement priority "1". If no printed dot exists at the position of dot T3, no process is done.

Similarly in T4 discharge failure complement 407 of FIG. 4, if a printed dot exists at the position of dot T4, the complement process is done using a dot except complement dots formed at T1, T2, and T3 and original printed dots. In 407 of FIG. 4, complement is performed at a position having discharge failure complement priority "1". If no printed dot exists at the position of dot T4, no process is done.

After the complement process for dots T1 to T4 ends, the complement process is performed for v1, v2, v3, and v4 by the same algorithm.

This will be explained briefly.

In v1 discharge failure complement 408 of FIG. 4, if a printed dot exists at the position of dot v1, the complement process is done using a dot except complement dots formed at T1 to T4 and original printed dots. In 408 of FIG. 4, complement is performed at a position having discharge failure complement priority "3". If no printed dot exists at the position of dot v1, no process is done.

In v2 discharge failure complement 409 of FIG. 4, if a printed dot exists at the position of dot v2, the complement process is done using a dot except complement dots formed at T1 to T4 and v1 and original printed dots. In 409 of FIG. 4, complement is performed at a position having discharge failure complement priority "1". If no printed dot exists at the position of dot v2, no process is done.

In v3 discharge failure complement 410 of FIG. 4, if a printed dot exists at the position of dot v3, the complement process is done using a dot except complement dots formed at T1 to T4, v1, and v2 and original printed dots. In 410 of FIG. 4, complement is performed at a position having discharge failure complement priority "1". If no printed dot exists at the position of dot v3, no process is done.

In v4 discharge failure complement 411 of FIG. 4, if a printed dot exists at the position of dot v4, the complement process is done using a dot except complement dots formed at T1 to T4 and v1 to v3 and original printed dots. In 411 of FIG. 4, complement is performed at a position having discharge failure complement priority "1". If no printed dot exists at the position of dot v4, no process is done.

Figure 5:
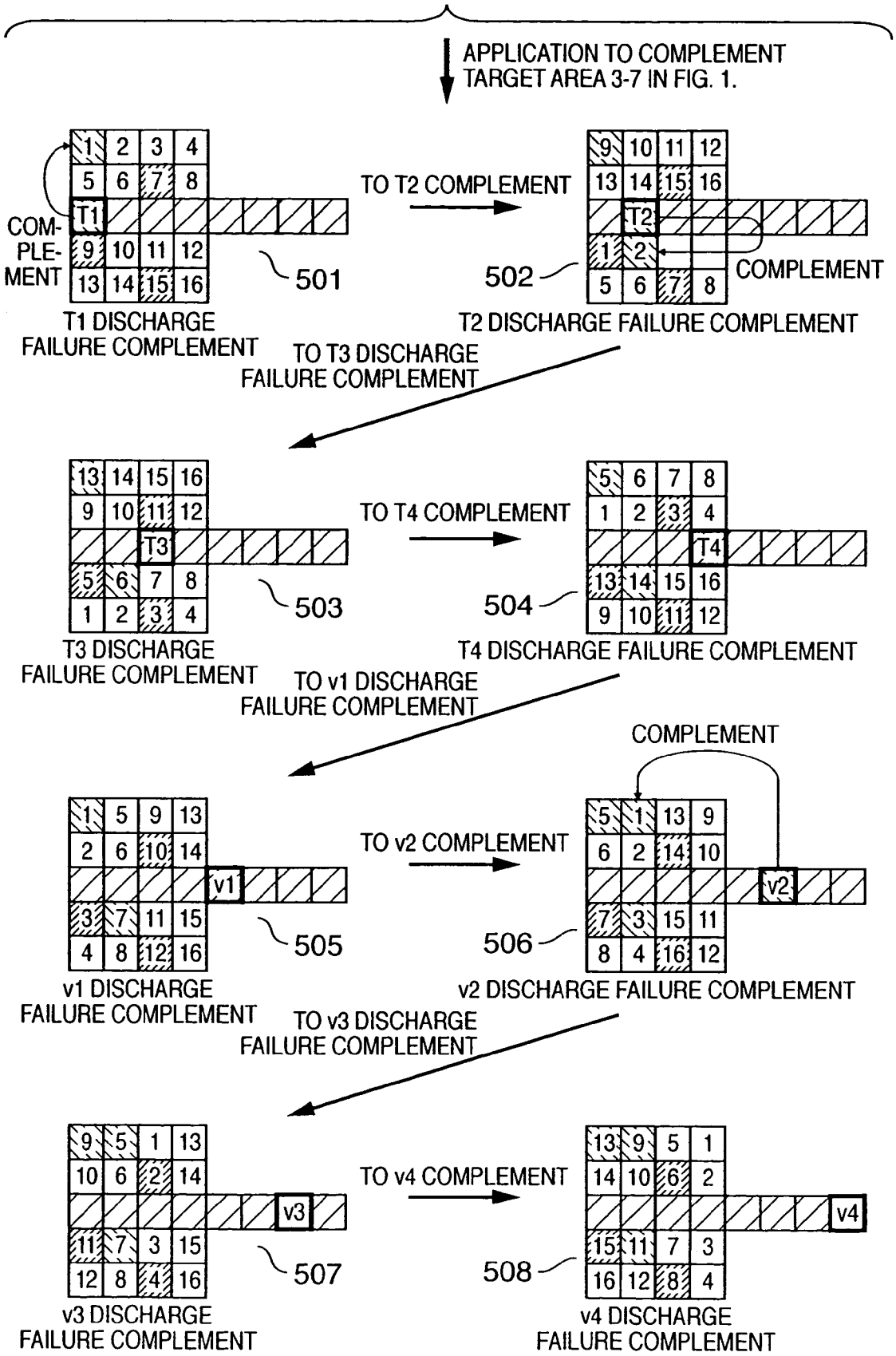
FIG. 5 is a view for explaining involvement of dots within the virtual dot area in discharge failure complement.

FIG. 5 is a view showing states in which the above-described algorithm is applied to execute discharge failure complement for the printing area of a discharge failure nozzle and virtual dots within the complement target area 3-7 shown in FIG. 3A. FIG. 5 assumes that priorities shown in FIG. 3B are assigned as discharge failure complement priorities for discharge failure dots before complement.

T1 discharge failure complement 501 of FIG. 5 illustrates a state in which T1 discharge failure complement is done. In this case, a printed dot exists at the position of dot T1, and no printed dot exists at a position of discharge failure complement priority "1". Thus, print failure dot T1 is moved to the position of discharge failure complement priority "1".

In T2 discharge failure complement 502 of FIG. 5 executed next, a printed dot exists at the position of dot T2, and a printed dot exists at the position of discharge failure complement priority "1". The second highest discharge failure complement priority is searched for. Since a position having discharge failure complement priority "2" is blank, print failure dot T2 is moved to the position of discharge failure complement priority "2".

T3 discharge failure complement 503 of FIG. 5 is executed next. In this case, no printed dot exists at the position of dot T3, and no complement process is performed.

T4 discharge failure complement 504 of FIG. 5 is executed next. In this case, no printed dot exists at the position of dot T4, and no complement process is performed.

V1 discharge failure complement 505 of FIG. 5 is executed next. However, no printed dot exists at the position of dot v1, and no complement process is performed.

V2 discharge failure complement 506 of FIG. 5 is executed next. In this case, a printed dot exists at the position of dot v2, and no printed dot exists at a position of discharge failure complement priority "1". Dot v2 is moved to the position of discharge failure complement priority "1".

V3 discharge failure complement 507 of FIG. 5 is executed next. However, no printed dot exists at the position of dot v3, and no complement process is performed.

V4 discharge failure complement 508 of FIG. 5 is executed at last. However, no printed dot exists at the position of dot v4, and no complement process is performed.

The principle of the above-described complement process will be briefly summarized. In the prior art, one print failure dot is simply moved to one position of another normal nozzle. To the contrary, this embodiment introduces the concept "virtual dot area". Virtual dots are generated from the pattern of print failure dots present within several columns, and data processing is executed as if the virtual dots were some of print failure dots.

A printing apparatus which implements the present invention will be explained.

2. Arrangement of Printing Apparatus

<Description of Inkjet Printing Apparatus (FIG. 6)>

Figure 6:
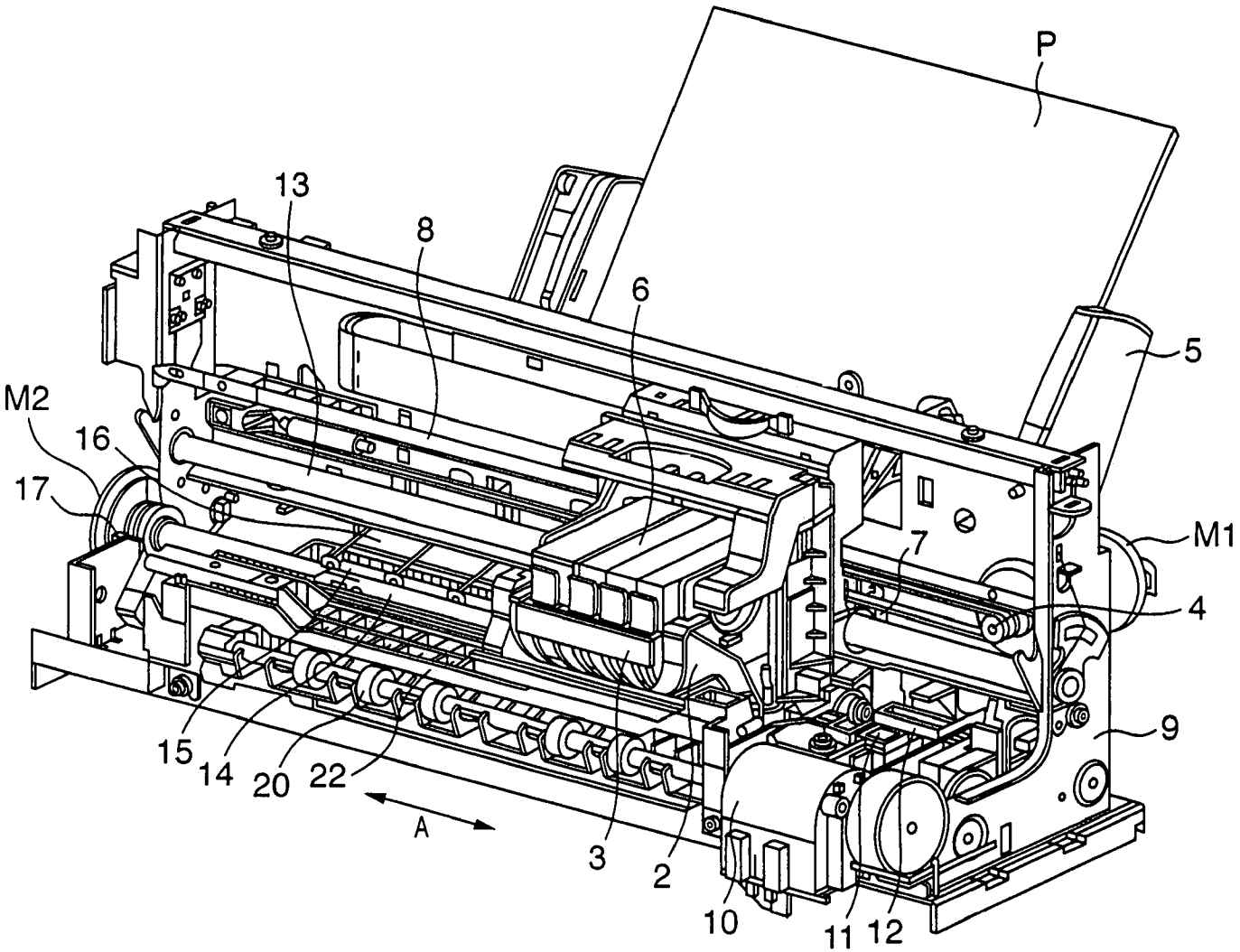
FIG. 6 is an outer perspective view showing the schematic arrangement of an inkjet printing apparatus as a typical embodiment of the present invention.

FIG. 6 is a perspective view showing an external appearance of the configuration of an inkjet printing apparatus 1 which is a typical embodiment of the present invention.

As shown in FIG. 6, the inkjet printing apparatus 1 (hereinafter referred to as the printer) shown in FIG. 1 performs printing in the following manner. Driving force generated by a carriage motor M1 is transmitted from a transmission mechanism 4 to a carriage 2 incorporating a printhead 3, which performs printing by discharging ink in accordance with an inkjet method, and the carriage 2 is reciprocally moved in the direction of arrow A. A printing medium P, e.g., printing paper, is fed by a paper feeding mechanism 5 to be conveyed to a printing position, and ink is discharged by the printhead 3 at the printing position of the printing medium P1 thereby realizing printing.

To maintain an excellent state of the printhead 3, the carriage 2 is moved to the position of a recovery device 10, and discharge recovery processing of the printhead 3 is intermittently performed.

In the carriage 2 of the printer 1, not only the printhead 3 is mounted, but also an ink cartridge 6 reserving ink to be supplied to the printhead 3 is mounted. The ink cartridge 6 is attachable/detachable to/from the carriage 2.

The printer 1 shown in FIG. 6 is capable of color printing. Therefore, the carriage 2 holds four ink cartridges respectively containing magenta (M), cyan (C), yellow (Y), and black (K) inks. These four cartridges are independently attachable/detachable.

Appropriate contact between the junction surfaces of the carriage 2 and the printhead 3 can achieve necessary electrical connection. By applying energy to the printhead 3 in accordance with a printing signal, the printhead 3 selectively discharges ink from plural discharge orifices, thereby performing printing. In particular, the printhead 3 according to this embodiment adopts an inkjet method which discharges ink by utilizing heat energy, and comprises electrothermal transducers for generating heat energy. Electric energy applied to the electrothermal transducers is converted to heat energy, which is then applied to ink, thereby creating film boiling. This film boiling causes growth and shrinkage of a bubble in the ink, and generates a pressure change. By utilizing the pressure change, ink is discharged from the discharge orifices. The electrothermal transducer is provided in correspondence with each discharge orifice. By applying a pulsed voltage to the corresponding electrothermal transducer in accordance with a printing signal, ink is discharged from the corresponding discharge orifice.

As shown in FIG. 6, the carriage 2 is connected to a part of a driving belt 7 of the transmission mechanism 4 which transmits driving force of the carriage motor M1, and is slidably supported along a guide shaft 13 in the direction of arrow A. Therefore, the carriage 2 reciprocally moves along the guide shaft 13 in accordance with normal rotation and reverse rotation of the carriage motor M1. In parallel with the moving direction of the carriage 2 (direction of arrow A), a scale 8 is provided to indicate an absolute position of the carriage 2. In this embodiment, the scale 8 is a transparent PET film on which black bars are printed in necessary pitches. One end of the scale 8 is fixed to a chassis 9, and the other end is supported by a leaf spring (not shown).

In the printer 1, a platen (not shown) is provided opposite to the discharge orifice surface where discharge orifices (not shown) of the printhead 3 are formed. As the carriage 2 incorporating the printhead 3 is reciprocally moved by the driving force of the carriage motor M1, a printing signal is supplied to the printhead 3 to discharge ink, and printing is performed on the entire width of the printing medium P conveyed on the platen.

Furthermore, in FIG. 6, numeral 14 denotes a conveyance roller driven by a conveyance motor M2 for conveying the printing medium P. Numeral 15 denotes a pinch roller that presses the printing medium P against the conveyance roller 14 by a spring (not shown). Numeral 16 denotes a pinch roller holder which rotatably supports the pinch roller 15. Numeral 17 denotes a conveyance roller gear fixed to one end of the conveyance roller 14. The conveyance roller 14 is driven by rotation of the conveyance motor M2 transmitted to the conveyance roller gear 17 through an intermediate gear (not shown).

Numeral 20 denotes a discharge roller for discharging the printing medium P, where an image is formed by the printhead 3, outside the printer. The discharge roller 20 is driven by receiving rotation of the conveyance motor M2. Note that the discharge roller 20 presses the printing medium P by a spur roller (not shown) that presses the printing medium by a spring. Numeral 22 denotes a spur holder which rotatably supports the spur roller.

Furthermore, as shown in FIG. 6, the printer 1 includes the recovery device 10 for recovering discharge failure of the printhead 3, which is arranged at a desired position (e.g., a position corresponding to the home position) outside the reciprocal movement range for printing operation (outside the printing area) of the carriage 2 that incorporates the printhead 3.

The recovery device 10 comprises a capping mechanism 11 for capping the discharge orifice surface of the printhead 3, and a wiping mechanism 12 for cleaning the discharge orifice surface of the printhead 3. In conjunction with the capping operation of the capping mechanism 11, suction means (suction pump or the like) of the recovery device enforces ink discharge from the discharge orifices, thereby executing discharge recovery operation, that is, removing high-viscosity ink and bubbles in the ink channel of the printhead 3.

In addition, when printing operation is not performed, the discharge orifice surface of the printhead 3 is capped by the capping mechanism 11 for protecting the printhead 3 and preventing ink from evaporation and drying. The wiping mechanism 12 is arranged in the neighborhood of the capping mechanism 11 for wiping off an ink droplet attached to the discharge orifice surface of the printhead 3.

By virtue of the capping mechanism 11 and wiping mechanism 12, a normal ink discharge condition of the printhead 3 can be maintained.

Figure 7:
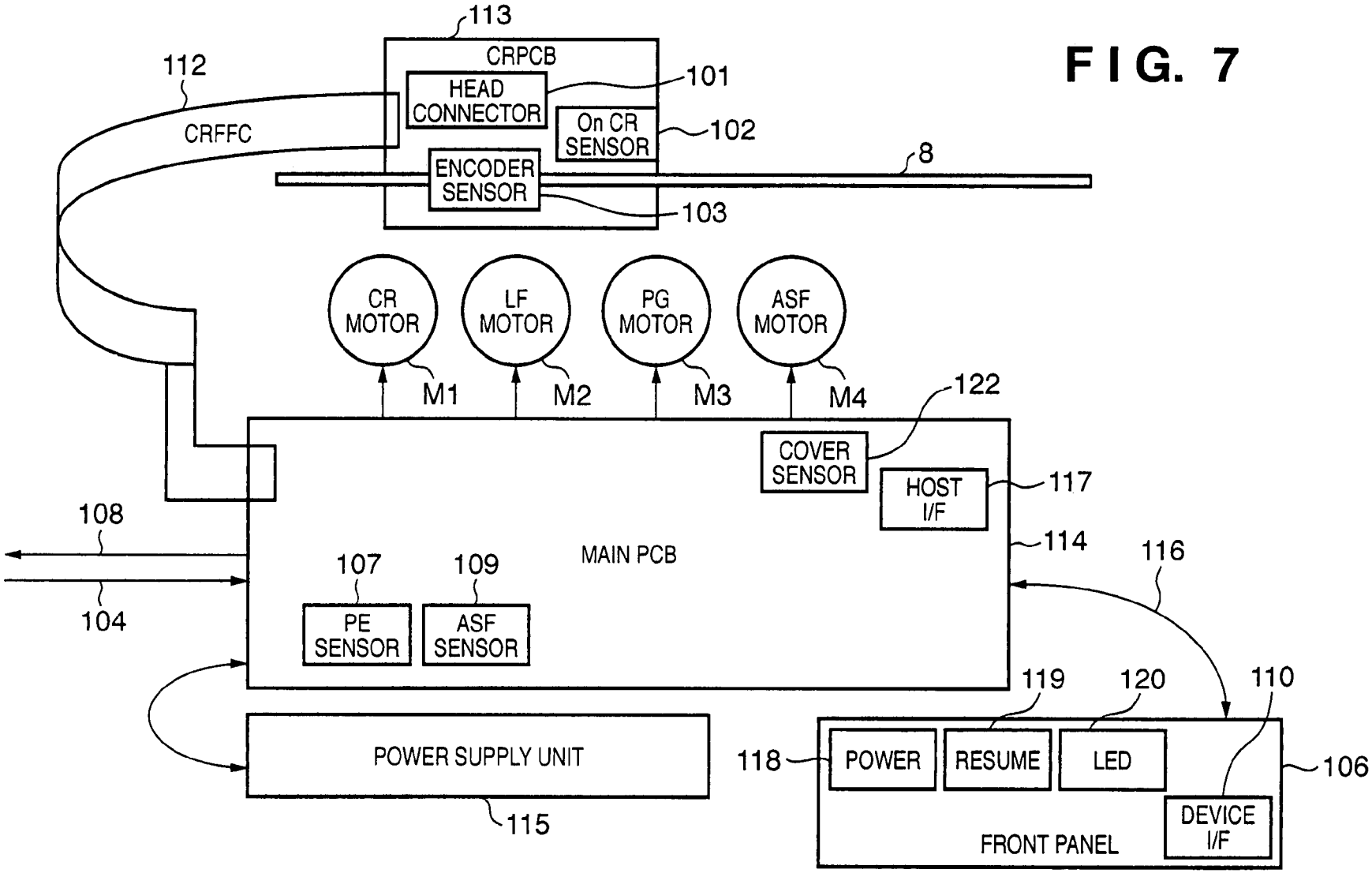
FIG. 7 is a block diagram schematically showing the overall configuration of the electric circuit of the printing apparatus shown in FIG. 6.

FIG. 7 is a block diagram schematically showing the overall configuration of the electric circuit of the printing apparatus shown in FIG. 6.

The electric circuit in this embodiment is mainly comprised of a carriage board (CRPCB) 113, main PCB (Printed Circuit Board) 114, power supply unit 115, front panel 106, and the like.

The power supply unit 115 is connected to the main PCB 114, and supplies various driving powers. The carriage board 113 is a printed board unit mounted on the carriage 2, and functions as an interface which exchanges signals with the printhead 3 via a head connector 101. In addition, the carriage board 113 detects a change in the relative positional relationship between the scale 8 and an encoder sensor 103 on the basis of a pulse signal output from the encoder sensor 103 along with movement of the carriage 2, and outputs the output signal to the main PCB 114 via a flexible flat cable (CRFFC) 112. The carriage board 113 supports an On CR sensor 102, and outputs ambient temperature information of a thermistor (not shown) and reflected light information of an optical sensor together with head temperature information of the printhead 3 to the main PCB 114 via the flexible flat cable (CRFFC) 112.

The main PCB 114 is a printed board unit which drives and controls each unit of the printing apparatus in this embodiment. The board comprises a paper end detection sensor (PE sensor) 107, automatic sheet feeder (ASF) sensor 109, cover sensor 122, and host interface (host I/F) 117.

The main PCB 114 is connected to the CR motor M1 serving as a driving source for scanning the carriage 2, the LF motor M2 serving as a driving source for conveying a printing medium, a PG motor M3 serving as a driving source for printhead recovery operation, and an ASF motor M4 serving as a driving source for sheet feed operation of a printing medium. The main PCB 114 drives and controls these motors. In addition, the main PCB 114 comprises an input unit for inputting sensor signals 104 from an ink presence/absence detection sensor, a medium type determination sensor, a carriage position (height) sensor, an LF encoder sensor, a PG sensor, switch sensors representing the attachment/operation states of various optional units, and an output unit which outputs an option control signal 108 for driving and controlling various optional units. The main PCB 114 further comprises a connection interface (panel signal 116) with the CRFFC 112, power supply unit 115, and front panel 106.

The front panel 106 is a unit which is arranged on the front surface of the printing apparatus main body for convenience of user operation. The front panel 106 comprises a power key 118, a resume key 119, an LED 120, and a device I/F 110 used to connect a peripheral device such as a digital camera.

Figure 8:
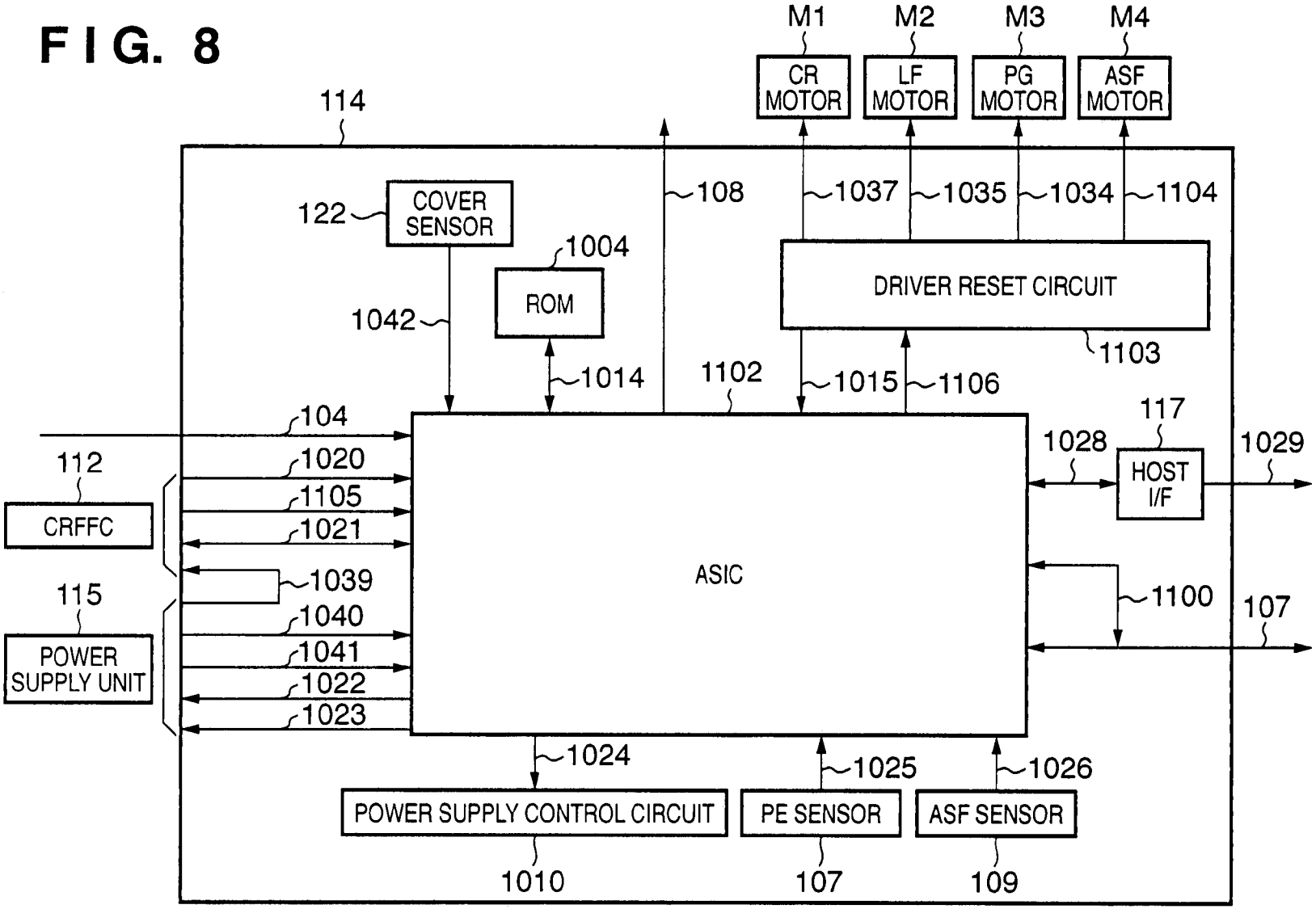
FIG. 8 is a block diagram showing the internal configuration of a main PCB 114.

FIG. 8 is a block diagram showing the internal configuration of the main PCB 114.

In FIG. 8, reference numeral 1102 denotes an ASIC (Application Specific Integrated Circuit) which is connected to a ROM 1004 via a control but 1014. In accordance with a program stored in the ROM 1004, the ASIC 1102 detects outputs from sensors on the main PCB 114, input of the sensor signal 104, an On CR sensor signal 1105 and encoder signal 1020 from the CRFFC 112, and outputs from the power key 118 and resume key 119 on the front panel 106. The ASIC 1102 performs various logical calculation/condition determination operations and the like in accordance with the connection/data input states of the host I/F 117 and the device I/F 110 on the front panel. The ASIC 1102 controls various constituent components described above and to be described later, and drives and controls the printing apparatus.

Reference numeral 1103 denotes a driver reset circuit which uses a motor power supply (VM) 1040 as a driving source. The driver reset circuit 1103 generates a CR motor driving signal 1037, LF motor driving signal 1035, PG motor driving signal 1034, and ASF motor driving signal 1104 in accordance with a motor control signal 1106 from the ASIC 1102, and drives the motors. The driver reset circuit 1103 comprises a power supply circuit, and supplies necessary powers (not shown) to respective units such as the main PCB 114, CRPCB 113, and front panel 106. Further, the driver reset circuit 1103 detects a drop in power supply voltage, and generates and initializes a reset signal 1015.

Reference numeral 1010 denotes a power supply control circuit which controls power supply to, e.g., each sensor having a light-emitting element in accordance with a power supply control signal 1024 from the ASIC 1102. The host I/F 117 transmits a host I/F signal 1028 from the ASIC 1102 to an externally connected host I/F cable 1029, and transmits a signal from the host I/F cable 1029 to the ASIC 1102. The power supply control circuit 1010 receives a head power (VH) 1039, motor power (VM) 1040, and logic power (VDD) 1041 from the power supply unit 115.

A head power ON signal (VHON) 1022 and motor power ON signal (VMOM) 1023 from the ASIC 1102 are input to the power supply unit 115 to control the ON/OFF states of the head power 1039 and motor power 1040. The logic power (VDD) 1041 supplied from the power supply unit 115 is converted into a voltage, as needed, and then supplied to units inside and outside the main PCB 114.

The head power signal 1039 is smoothed on the main PCB 114, then sent to the CRFFC 112, and used to drive the printhead 3. The ASIC 1102 is a 1-chip semiconductor integrated circuit incorporating a processor. The ASIC 1102 outputs the motor control signal 1106, option control signal 108, power supply control signal 1024, head power ON signal 1022, motor power ON signal 1023, and the like. The ASIC 1102 exchanges signals with the host I/F 117, and exchanges signals with the device I/F 110 on the front panel via the panel signal 116. The ASIC 1102 detects the states of a PE detection signal (PES) 1025 from the PE sensor 107, an ASF detection signal (ASFS) 1026 from the ASF sensor 109, a cover detection signal (COVS) 1042 from the cover sensor 122, the panel signal 116, the sensor signal 104, and the On CR sensor signal 1105. The ASIC 1102 controls driving of the panel signal 116 so that the LED 120 on the front panel can flicker.

Also, the ASIC 1102 detects the state of the encoder signal (ENC) 1020, generates a timing signal, interfaces the printhead 3 by using a head control signal 1021, and controls printing operation. The encoder signal (ENC) 1020 is an output signal of the encoder sensor 103 input via the CRFFC 112. The head control signal 1021 is supplied to the printhead 3 via the flexible flat cable (CRFFC) 112, carriage board 113, and head connector 101.

Figure 9:
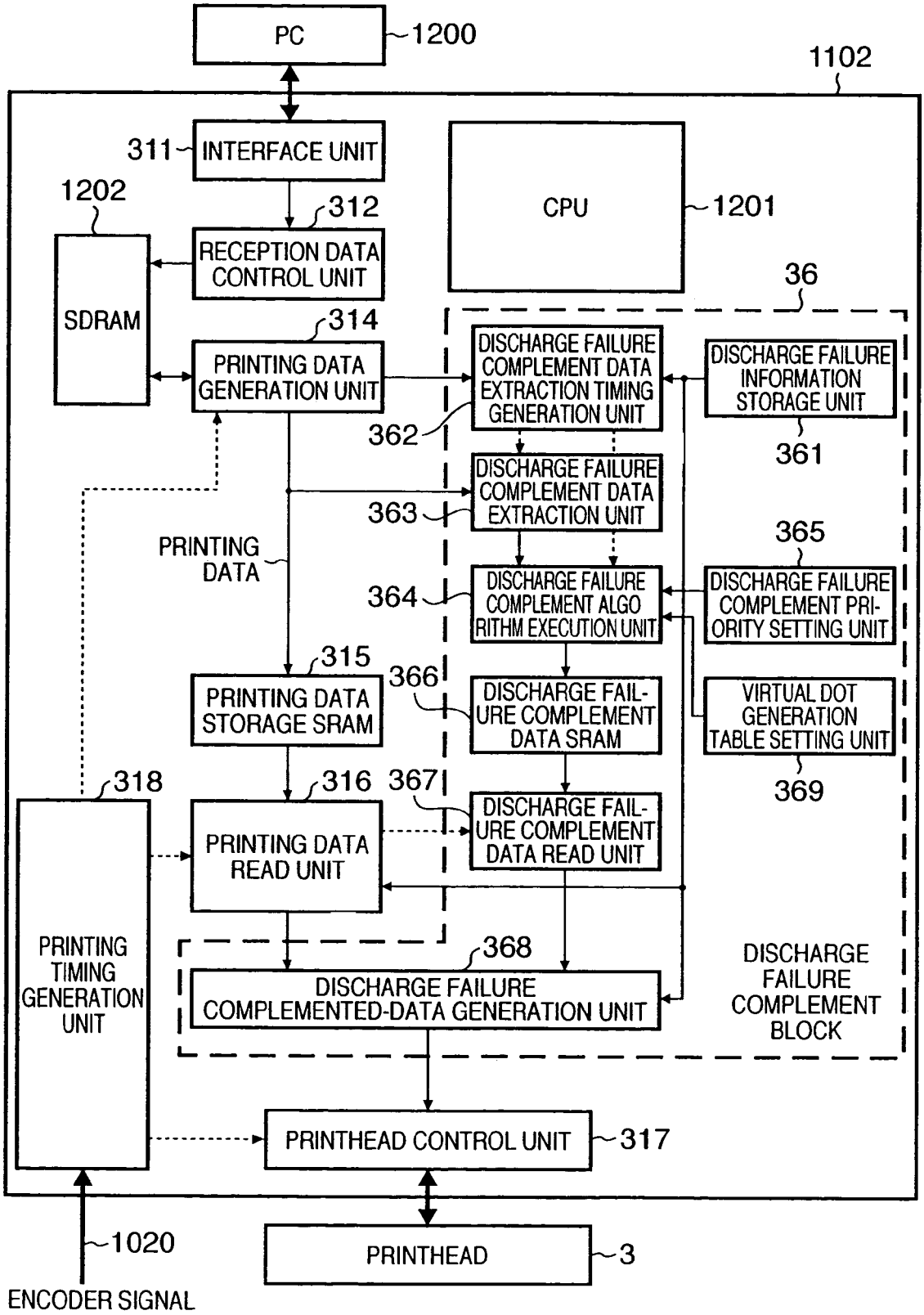
FIG. 9 is a block diagram showing the internal function configuration of an ASIC 1102 and its schematic data flow.

FIG. 9 is a block diagram showing the internal function configuration of the ASIC 1102 and its schematic data flow. The ASIC of an actual printing apparatus has a more complicated structure. In this case, the internal configuration will be explained only along part associated with the discharge failure complement function according to this embodiment.

In a description of the data flow of the discharge failure complement function, two elements are necessary in addition to the ASIC 1102 for easy understanding of the function. One element is a personal computer (PC) 1200, and the other is the printhead 3. The PC 1200 exists outside the printing apparatus incorporating the discharge failure complement function according to this embodiment. The PC 1200 transfers printing data to the printing apparatus, more specifically, to the data reception unit of the ASIC 1102. The printhead 3 generates a printed image as a product obtained by operating the printing apparatus. As described above, the printhead 3 includes a discharge failure nozzle in addition to normal nozzles. Data for controlling the operation of the printhead 3, i.e., printing data, a discharge pulse signal, and the like are generated within the ASIC 1102.

3. Discharge Failure Complement Data Generation Process and Printing Data Generation Process The internal function of the ASIC 1102 will be explained.

Main functional blocks will be described with reference to FIG. 9. Reference numeral 1201 denotes a CPU which controls and manages the whole operation of the ASIC 1102; and 1202, an SDRAM serving as a main memory for the printing apparatus. The main memory need not always be an SDRAM, and may be a memory such as a DRAM or SRAM other than the SDRAM as far as the memory belongs to the definition of the RAM. The remaining blocks in the ASIC 1102 form a so-called random logic part which implements an operation unique to the printing apparatus and an operation unique to the discharge failure complement function according to this embodiment.

The random logic part will be explained.

Reference numeral 311 denotes an interface unit which receives data transferred from the PC 1200. For example, the interface unit 311 receives a signal in accordance with an interface protocol complying with IEEE1284, USB, IEEE1394, or the like, and generates data in a format easily processible by the ASIC 1102 (in general, data is formatted in unit of byte). Data received into the ASIC 1102 via the interface unit 311 is sent to a reception data control unit 312.

The reception data control unit 312 receives data from the interface unit 311, and saves the data in the SDRAM 1202. Part of the SDRAM 1202 that is controlled by the reception data control unit 312 is often called a reception buffer.

Data saved in the SDRAM 1202 by the reception data control unit 312 is loaded into a printing data generation unit 314 in accordance with each printing control timing, thus generating printing data. In general, the printing data generation unit 314 is divided into various functions for different roles such as an H-V conversion unit, data mapping unit, and multi-pass mask control unit. When the respective functions access the SDRAM 1202 and perform data processes by their own functions, the access areas in the SDRAM 1202 are generally called by different names, i.e., a work buffer, print buffer, mask buffer, and the like. These functions are substantially irrelevant to the discharge failure complement function and are called a "printing data generation unit" as a whole, and a detailed description thereof will be omitted.

Printing data created by the printing data generation unit 314 is saved in a printing data storage SRAM 315. The printing data storage SRAM 315 is not indispensable to the system. In many cases, recent printing apparatuses generate a large amount of printing data in advance to increase the printing speed, and printing data is temporarily stored in a high-speed accessible memory such as an SRAM (DRAM is not proper because of a long access time). It is important that the target printing data is data having completely undergone various data processes such as a multi-pass process, index data mapping, and a mask process. The data can be printed immediately when the printing data is sent to a printhead control unit 317. The discharge failure complement function described in this embodiment further executes the discharge failure complement process for the data.

Printing data is read out from the printing data storage SRAM 315 by a printing data read unit 316. At this time, if no discharge failure nozzle exists in the printhead 3, the data read out to the printing data read unit 316 is directly sent to the printhead control unit 317. The printhead control unit 317 performs control unique to the printhead 3 so that the printhead control unit 317 transfers the received printing data to the printhead 3 and transfers a heat pulse signal to the printhead 3.

A printing timing generation unit 318 generates various printing timings based on the encoder signal 1020. The printing timing generation unit 318 generates signals at a proper interval from the encoder signal 1020 so as to enable the printing data generation unit 314, the printing data read unit 316, the printhead control unit 317, and a discharge failure complement data read unit 367 (to be described later) to exchange data at proper timings.

Part associated with the discharge failure complement function according to this embodiment will be explained. Blocks associated with the discharge failure complement function are blocks in the area of a discharge failure complement block 36 surrounded by the broken line in the ASIC 1102.

A discharge failure information storage unit 361 sets a nozzle position at which a discharge failure nozzle exists in the printhead. This setting is done by the CPU 1201. Discharge failure nozzle information set in the discharge failure information storage unit 361 is transferred to a discharge failure complement data extraction timing generation unit 362, the printing data read unit 316, and a discharge failure-complemented data generation unit 368.

The discharge failure complement data extraction timing generation unit 362 generates a discharge failure complement data extraction timing signal on the basis of the transferred data. The printing data generation unit 314 is capable of discriminating which nozzle data in the printhead 3 is currently being generated and written into the printing data storage SRAM 315 (regardless of whether the nozzle is a normal one or discharge failure one). By receiving from the printing data generation unit 314 information on the relationship between currently processed printing data and a nozzle in the printhead 3, it can be determined whether the currently processed data is discharge data of a discharge failure nozzle, or discharge data of an upper or lower nozzle position of the discharge failure nozzle at which discharge failure complement should be executed, as described in the principle. If the printhead is free from any discharge failure nozzle, the discharge failure complement data extraction timing generation unit 362 does not output any signal.

Based on the data, the discharge failure complement data extraction timing generation unit 362 notifies a discharge failure complement data extraction unit 363 of a timing at which discharge failure complement data (representing both discharge data of a discharge failure nozzle and printing data of a normal nozzle position subjected to discharge failure complement) is received. The discharge failure complement data extraction unit 363 is connected to a signal line for printing data output from the printing data generation unit 314. Thus, the discharge failure complement data extraction unit 363 can extract only discharge failure complement data from printing data in accordance with the timing notified by the discharge failure complement data extraction timing generation unit 362. The extracted discharge failure complement data is transferred to a discharge failure complement algorithm execution unit 364. The discharge failure complement algorithm execution unit 364 is a block which performs discharge failure complement data calculation described in the principle.

According to the above-described principle, discharge failure complement data calculation requires discharge failure complement priority. Thus, a discharge failure complement priority setting unit 365 transfers discharge failure complement priority data to the discharge failure complement algorithm execution unit 364. The discharge failure complement priority setting unit 365 has a function capable of setting discharge failure complement priority in accordance with setting by the CPU 1201. The discharge failure complement priority means both discharge failure dot complement priority and virtual dot complement priority according to the principle described above.

In addition, discharge failure complement data calculation requires a virtual dot generation table. A virtual dot generation table setting unit 369 transfers virtual dot generation table data to the discharge failure complement algorithm execution unit 364.

By arranging the discharge failure complement priority setting unit 365 and virtual dot generation table setting unit 369, the discharge failure complement priority can be flexibly changed by firmware even after the ASIC 1102 is designed and manufactured.

The discharge failure complement algorithm execution unit 364 is an important function in the embodiment, and will be described in detail with reference to the accompanying drawings.

Figure 10:
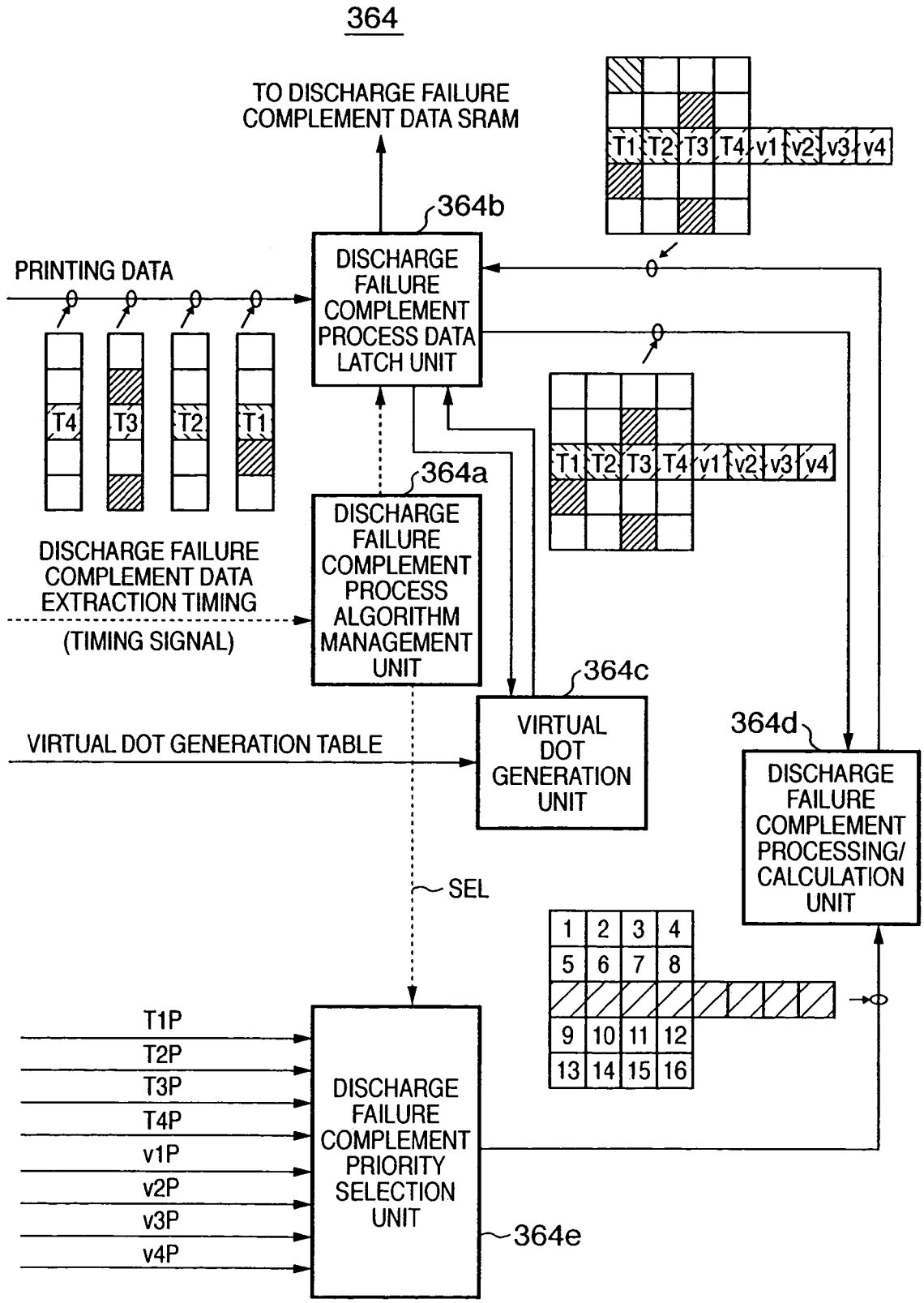
FIG. 10 is a block diagram showing the mechanism of a discharge failure complement algorithm execution unit 364 in more detail.

FIG. 10 is a block diagram showing the mechanism of the discharge failure complement algorithm execution unit 364 in more detail.

As described above, the discharge failure complement algorithm execution unit 364 receives discharge failure complement priority data, extracted discharge failure complement data (discharge data of a discharge failure nozzle and printing data of a normal nozzle position subjected to discharge failure complement), and virtual dot generation table data. Before a description with reference to FIG. 10, the following settings must be done for discharge failure complement. That is, as shown in FIG. 10, discharge failure complement is performed in a range defined by two upper normal nozzle positions and two lower normal nozzle positions of a discharge failure nozzle and four columns, as shown in FIG. 2A to 2C, as described in the principle. In addition, the process is executed in order of T1→T2→T3→T4→v1→v2→v3→v4.

The discharge failure complement algorithm execution unit 364 receives a timing signal from the discharge failure complement data extraction timing generation unit 362, and receives discharge failure complement data from the discharge failure complement data extraction unit 363. After discharge failure complement data are received over a range of four columns, control to sequentially perform calculation for the respective columns is necessary. This control is performed by a discharge failure complement algorithm management unit 364*a* which controls the overall operation of the discharge failure complement algorithm execution unit 364. This block receives a timing signal from the discharge failure complement data extraction timing generation unit 362, and outputs a signal on the basis of the timing signal so as to cause a discharge failure complement data latch unit 364*b* to latch discharge failure complement data. After discharge failure complement data of four columns are latched, the discharge failure complement algorithm management unit 364*a* starts the discharge failure complement process.

At the same time, a virtual dot generation unit 364*c* generates virtual dot data on the basis of virtual dot generation table data and discharge failure complement data. These data are generated in accordance with the above-described principle. When discharge failure complement data is input, virtual dot data is output in almost real time upon the lapse of a specified gate delay.

As illustrated in FIG. 10, the discharge failure complement data and virtual dot data (total of 24 bits) latched by the discharge failure complement data latch unit 364*b* are always output to a discharge failure complement processing unit 364*d* regardless of the operation clock frequency or the like.

As for discharge failure complement priority data, as shown in FIG. 10, eight data patterns (see FIG. 3B) are transferred from the discharge failure complement priority setting unit 365 for conversion at bits T1 to T4 and v1 to v4. Discharge failure complement priority data must be appropriately selected in accordance with the position of the current discharge failure dot during conversion. For this reason, the discharge failure complement algorithm management unit 364*a* first processes a discharge failure dot at position T1, and transfers a selection signal (SEL) to a discharge failure complement priority selection unit 364*e* so as to output discharge failure complement priority data (T1P) for processing T1.

The discharge failure complement data of four columns output from the discharge failure complement data latch unit 364*b* and the discharge failure complement priority data (T1P) for processing T1 that is output from the discharge failure complement priority selection unit 364*e* are input to the discharge failure complement processing/calculation unit 364*d*.

The function of the discharge failure complement processing/calculation unit 364*d* will described in detail.

Figure 11:
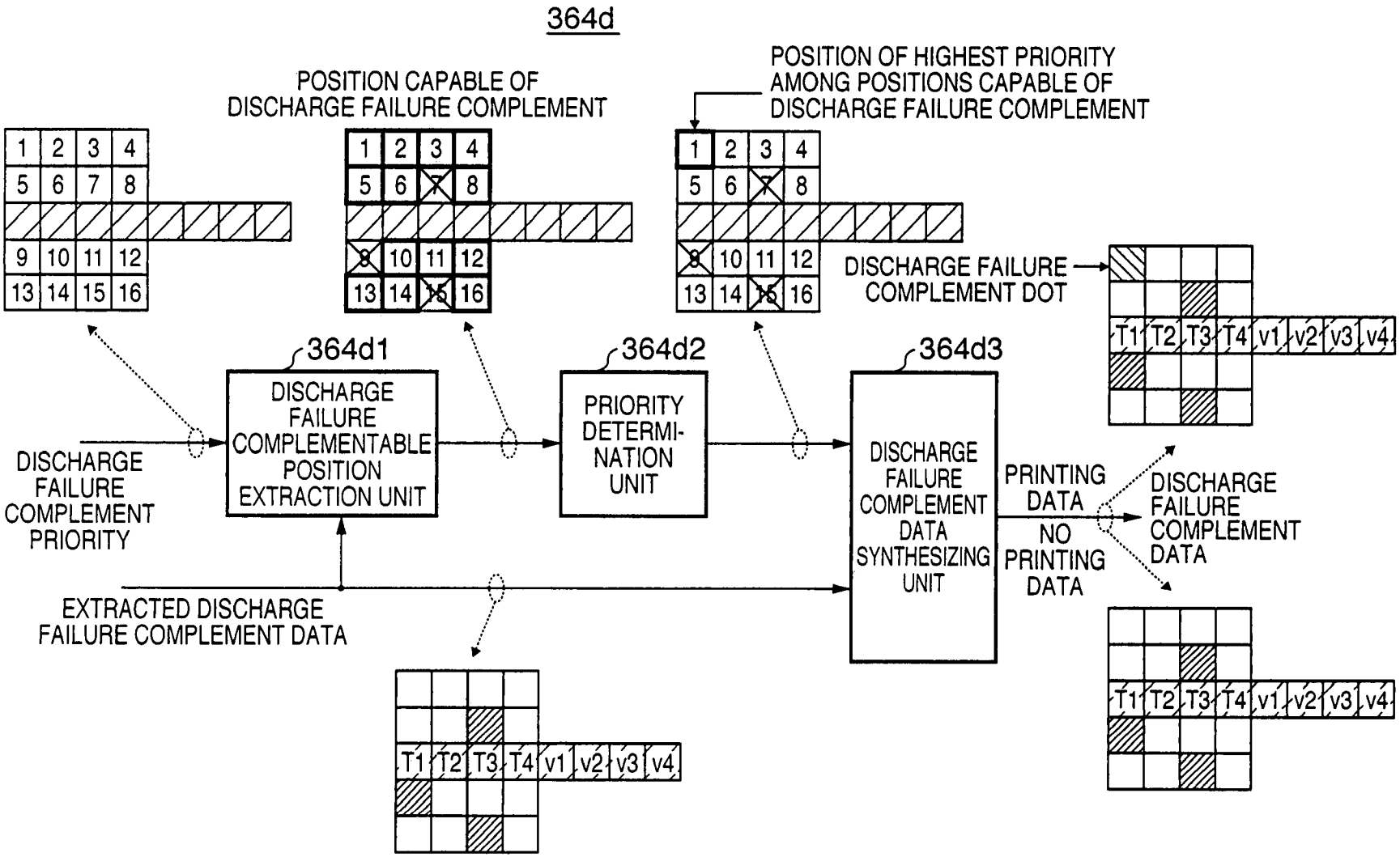
FIG. 11 is a block diagram showing details of the function of a discharge failure complement processing/calculation unit 364*d;*

FIG. 11 is a block diagram showing details of the function of the discharge failure complement processing/calculation unit 364*d*.

As shown in FIG. 11, two types of data, i.e., discharge failure complement priority data and extracted discharge failure complement data which are input to the discharge failure complement processing/calculation unit 364*d* are input to a discharge failure complementable position extraction unit 364*d*1. This block extracts, from the discharge failure complement priority data, only a priority at which no printing data by a normal nozzle exists and discharge failure complement can be done.

In the example shown in FIG. 11, printing data exist at positions of priorities "7", "9", and "15" in the discharge failure complement priority data, and the remaining priorities are effective for discharge failure complement. The extracted priority data usable for discharge failure complement is transferred to a priority determination unit 364*d*2. This block decides only the highest priority among priorities capable of discharge failure complement. In the example of FIG. 11, the highest priority among priorities capable of discharge failure complement is "1".

At last, a discharge failure complement data synthesizing unit 364*d*3 executes data synthesizing process, thereby completing discharge failure complement. This block synthesizes extracted discharge failure complement data and data at the position of the highest priority output from the priority determination unit 364*d*2, and creates discharge failure-complemented printing data. That is, the discharge failure complement data synthesizing unit 364*d*3 executes process of moving the input/extracted discharge failure complement data to a position represented by the decided priority. In executing this process, the discharge failure complement data synthesizing unit 364*d*3 determines whether or not printing data originally exists at the position of the discharge failure nozzle. If printing data exists at the position, the discharge failure complement data synthesizing unit 364*d*3 generates discharge failure-complemented printing data in the above-mentioned fashion, and outputs the printing data as an output of the discharge failure complement algorithm execution unit 364. If no printing data exists at the position, the discharge failure complement data synthesizing unit 364*d*3 simply outputs the extracted discharge failure complement data as an output of the discharge failure complement algorithm execution unit 364.

More specifically, the discharge failure complementable position extraction unit 364*d*1 determines a position capable of discharge failure complement from discharge failure complement data and discharge failure complement priority data (T1P) for processing T1. The priority determination unit 364*d*2 then determines the highest priority among positions capable of discharge failure complement. Finally, the discharge failure complement data synthesizing unit 364*d*3 performs discharge failure complement by using the discharge failure complement data and the position of the highest priority among positions capable of discharge failure complement. If printing data exists at discharge failure dot position T1, the printing data is moved to the position of the highest priority among positions capable of discharge failure complement. If no printing data exists at discharge failure dot position T1, input printing data is simply output. In this manner, discharge failure complement is achieved.

The discharge failure complement process data latch unit 364*b* which latches new discharge failure complement data of four columns having undergone discharge failure complement for printed dot T1 outputs the data to the discharge failure complement processing/calculation unit 364*d* again.

In order to process a discharge failure dot at position T2, the discharge failure complement algorithm management unit 364*a* transfers the selection signal (SEL) to the discharge failure complement priority selection unit 364*e* so as to output discharge failure complement priority data (T2P) for processing T2. The discharge failure complement processing/calculation unit 364*d* receives the discharge failure complement data of four columns having undergone the discharge failure complement process for printed dot T1, and the discharge failure complement priority data (T2P) for processing T2. The discharge failure complement data of four columns having undergone the discharge failure complement process for printed dots T1 and T2 are output after a proper gate delay in accordance with the above-described procedures.

The discharge failure complement algorithm management unit 364*a* waits until proper operation clocks (about two clocks are enough) are input. After that, the discharge failure complement algorithm management unit 364*a* transfers a control signal to the discharge failure complement process data latch unit 364*b* so as to update, as new discharge failure complement data of four columns, data output from the discharge failure complement processing/calculation unit 364*d*. The discharge failure complement process data latch unit 364*b* which latches the new discharge failure complement data of four columns having undergone the discharge failure complement process for printed dots T1 and T2 outputs the data to the discharge failure complement processing/calculation unit 364*d* again.

In order to process a discharge failure dot at position T3, the discharge failure complement algorithm management unit 364*a* transfers the selection signal (SEL) to the discharge failure complement priority selection unit 364*e* so as to output discharge failure complement priority data (T3P) for processing T3. The discharge failure complement processing/calculation unit 364*d* receives the discharge failure complement data of four columns having undergone the discharge failure complement process for printed dots T1 and T2, and the discharge failure complement priority data (T3P) for processing T3. The discharge failure complement data of four columns having undergone the discharge failure complement process for printed dots T1 to T3 are output after a proper gate delay in accordance with the above-described procedures.

The discharge failure complement algorithm management unit 364*a* waits until proper operation clocks (about two clocks are enough) are input. After that, the discharge failure complement algorithm management unit 364*a* transfers a control signal to the discharge failure complement process data latch unit 364*b* so as to update, as new discharge failure complement data of four columns, data output from the discharge failure complement processing/calculation unit 364*d*. The discharge failure complement process data latch unit 364*b* which latches the new discharge failure complement data of four columns having undergone the discharge failure complement process for printed dots T1 to T3 outputs the data to the discharge failure complement processing/calculation unit 364*d* again.

The discharge failure complement process is performed in accordance with the same procedures in order of T4→v1→v2→v3→v4. The discharge failure complement process data latch unit 364*b* transfers the newly completed discharge failure complement data of four columns having undergone the discharge failure complement process to a discharge failure complement data SRAM 366. Then, the discharge failure complement process for discharge failure complement of four columns ends.

This process is repeated every time discharge failure complement printing data of four columns are received.

A subsequent internal function of the ASIC 1102 will be described again with reference to FIG. 9.

Discharge failure-complemented data as a product of the discharge failure complement algorithm execution unit 364 is written in the discharge failure complement data SRAM 366. The discharge failure complement data SRAM 366 corresponds to the printing data storage SRAM 315 which stores printing data. The discharge failure-complemented data is final printing data, and may be stored in the printing data storage SRAM 315. In this case, the number of write blocks to the printing data storage SRAM 315 is two, i.e., the printing data generation unit 314 and discharge failure complement algorithm execution unit 364, and bus arbitration and access conflict may occur. If such event occurs, the throughput of the printer system may decrease. To prevent this, an SRAM is arranged for only discharge failure-complemented data. However, when the performance of the printer system abruptly improves in the future, the printing data storage SRAM 315 may store discharge failure-complemented data.

The discharge failure-complemented data written in the discharge failure complement data SRAM 366 is read out by the discharge failure complement data read unit 367 at a specified timing. The specified timing means that the discharge failure complement data read unit 367 is synchronized with the printing data read unit 316.

More specifically, the printing data storage SRAM 315 stores both printing data of a normal nozzle and printing data of a discharge failure nozzle. The discharge failure complement data SRAM 366 stores only printing data of nozzles around the discharge failure nozzle. The purpose of this embodiment is to appropriately replace data (printing data including both printing data of a normal nozzle and discharge failure nozzle) stored in the printing data storage SRAM 315 with data (printing data of nozzles around the discharge failure nozzle, i.e., discharge failure-complemented printing data) stored in the discharge failure complement data SRAM 366.

While the printing data read unit 316 reads out data of a nozzle associated with discharge failure complement, corresponding data is also read out from the discharge failure complement data SRAM 366. These two types of data must be properly selected to complete the processed printing data to be transferred to the printhead. It is also possible to read out data from the two SRAMs at unsynchronized read timings and properly select and merge the two types of data later. In this case, a circuit which executes this process increases in scale. This is not desirable in terms of the purpose of the present invention to provide a simple, small-scale system at low cost.

For this reason, the discharge failure complement data read unit 367 must read out discharge failure-complemented data on the basis of a read signal from the printing data read unit 316 in synchronism with the read signal. The printing data read unit 316 determines whether or not printing data currently read out from the unit 316 relates to discharge failure complement, and then outputs a read signal to the discharge failure complement data read unit 367. Thus, the printing-data read unit 316 requires discharge failure nozzle information output from the discharge failure information storage unit 361.

Discharge failure-complemented data read out from the discharge failure complement data read unit 367 is transferred to the discharge failure-complemented data generation unit 368 together with printing data (this printing data must be data of a nozzle position associated with discharge failure complement) synchronously read out from the printing data read unit 316. The data generation unit 368 merges the data transferred from the two transfer sources.

Figure 12:
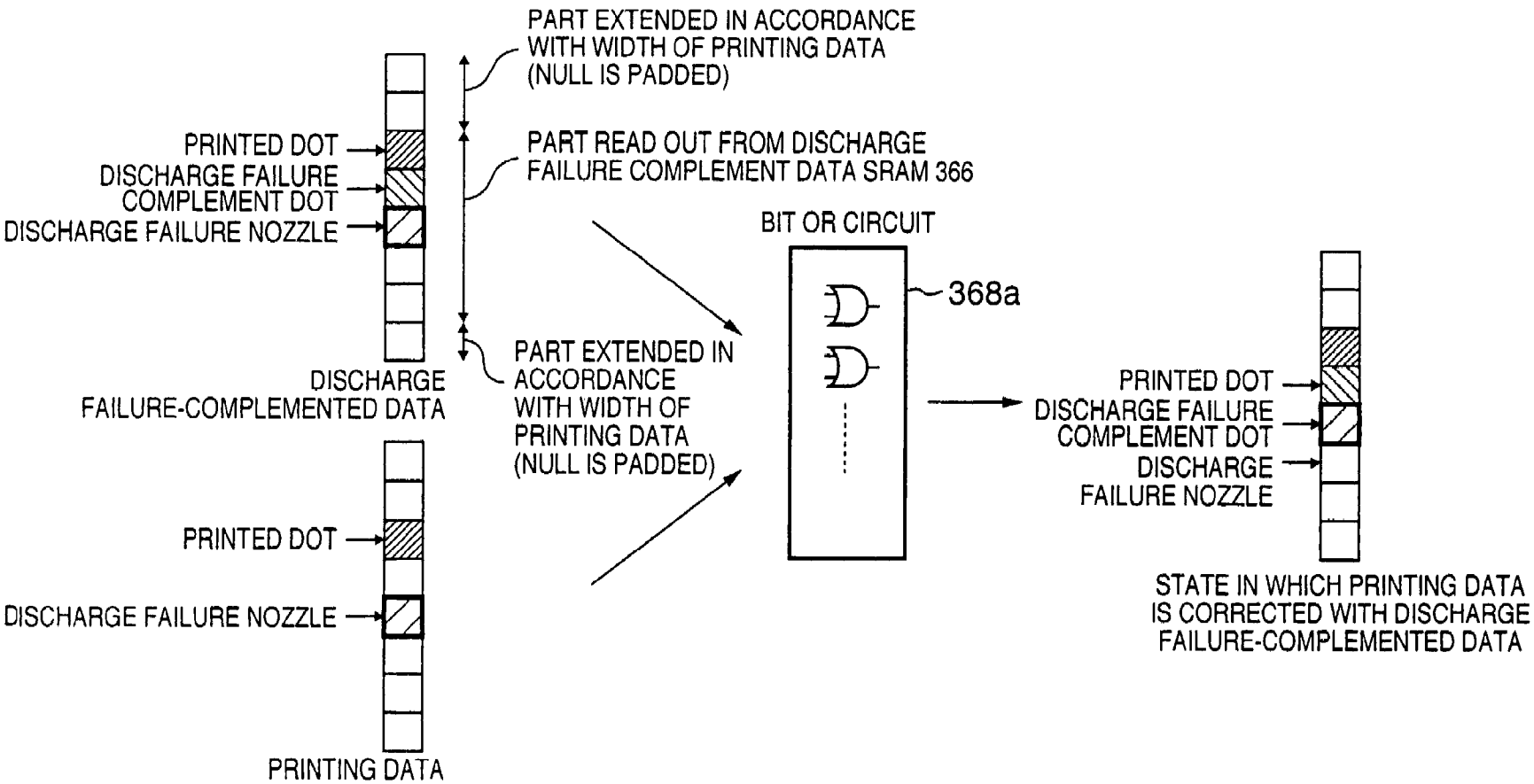
FIG. 12 is a view showing a process of merging discharge failure-complemented data and printing data.

FIG. 12 is a view showing process of merging discharge failure-complemented data and printing data.

The merge process will be briefly explained with reference to FIG. 12.

As described above, discharge failure-complemented data and printing data are input. The discharge failure-complemented data is extended to the same number of bits as that of printing data. In a general printer system, printing data is processed in unit of a multiple of eight bits such as bytes or words. However, discharge failure-complemented data does not have a multiple of eight bits, and may have a smaller number of bits. In the example described in this embodiment, a total number of bits are five: one bit for a discharge failure nozzle, and four bits for nozzles subjected to discharge failure complement (two upper nozzles and two lower nozzles of the discharge failure nozzle). In this case, the bit length of discharge failure-complemented data must be adjusted to the number of bits serving as the printing data process unit.

The embodiment assumes that printing data is processed in unit of eight bits (=one byte), as shown in FIG. 12. Discharge failure-complemented data is extended from five bits to eight bits. This extension is achieved by deciding positions to be extended on the basis of discharge failure nozzle position information transferred from the discharge failure information storage unit 361 and padding "0 (NULL data)" at positions to be extended.

The printing data and the extended data having undergone the discharge failure complement process are transferred to a bit OR circuit 368*a*. The bits are ORed, and the calculation result is output from the discharge failure-complemented data generation unit 368.

Referring to FIG. 12, discharge failure-complemented data (bit-extended data) which is an input to the discharge failure-complemented data generation unit 368 is identical to data output from the discharge failure-complemented data generation unit 368. The bit OR circuit 368*a* is not necessary in this case, but is necessary in some cases.

This embodiment assumes that nozzle printing data adjacent in the same 1-byte printing data are adjacent to each other similarly to nozzles of the printhead 3. However, in some printer systems, adjacent nozzle printing data may exist in different 1-byte printing data. This is derived from the difference in printhead configuration or printhead driving method, and printing data does not always have the format shown in FIG. 12. For this reason, it is necessary to process discharge failure-complemented data (extract necessary bits) and extend the data (pad "0" in accordance with the bit width of the printing data) in accordance with the printing data format. In this case, the read timing and the position at which data corresponding to a nozzle associated with the discharge failure complement process appears in printing data change. The printing data read unit 316 and discharge failure complement data read unit 367 must operate in cooperation with each other in accordance with the change.

Printing data containing the generated discharge failure complement data is transferred to the printhead control unit 317. The printhead control unit 317 transfers the printing data in accordance with a communication protocol with the printhead 3, and prints. This operation is the same as that in the absence of any discharge failure.

Conventional discharge failure complement is based on the assumption that one discharge failure print dot is moved to one position of another normal nozzle. To the contrary, the above-described embodiment introduces the concept "virtual dot area". According to this embodiment as described above, virtual dots are generated from the pattern of print failure dots present within several columns, and data process is performed as if the virtual dots were some of print failure dots. One or more (this embodiment defines four dots as virtual dots, and the number of print dots can be increased to four for one print failure dot) print dots can be moved to the positions of other normal nozzles for one print failure dot.

The printing density around a discharge failure nozzle can, therefore, be controlled by appropriately controlling virtual dots. Even if a discharge failure nozzle exists, high-quality image printing can be maintained by performing the discharge failure complement process according to this embodiment.

<Another Embodiment>

The above-described embodiment provides an almost perfect solution to the conventional problems and other problems. The complement process can be performed even if discharge failure nozzles exist at different positions in all the color nozzles of the printhead. Execution of the discharge failure complement process requires complement priority data and a virtual dot generation table.

According to the above-described embodiment, when the printhead copes with inks of seven colors (the maximum number of ink colors of one printing apparatus is seven as of the year 2003), seven sets of complement priority data and virtual dot generation tables are necessary in accordance with the number of colors. Implementation of these sets by hardware increases the number of data writable/readable registers, resulting a large number of gates in the ASIC.

The number of ink colors of one printing apparatus is predicted to increase in the future, and the hardware scale for implementing the discharge failure complement process is also predicted to increase in accordance with the number of ink colors. The ASIC scale does not increase if the same priority data and virtual dot generation table are used for inks of all colors. However, the influence of a discharge failure nozzle on an image changes depending on the ink color. The system is desirably equipped with different priority data and virtual dot generation tables for respective ink colors so as to tune discharge failure complement by firmware.

From the above study, this embodiment will focus on a discharge failure complement process which copes with even a future increase in the number of ink colors for use.

Figure 13:
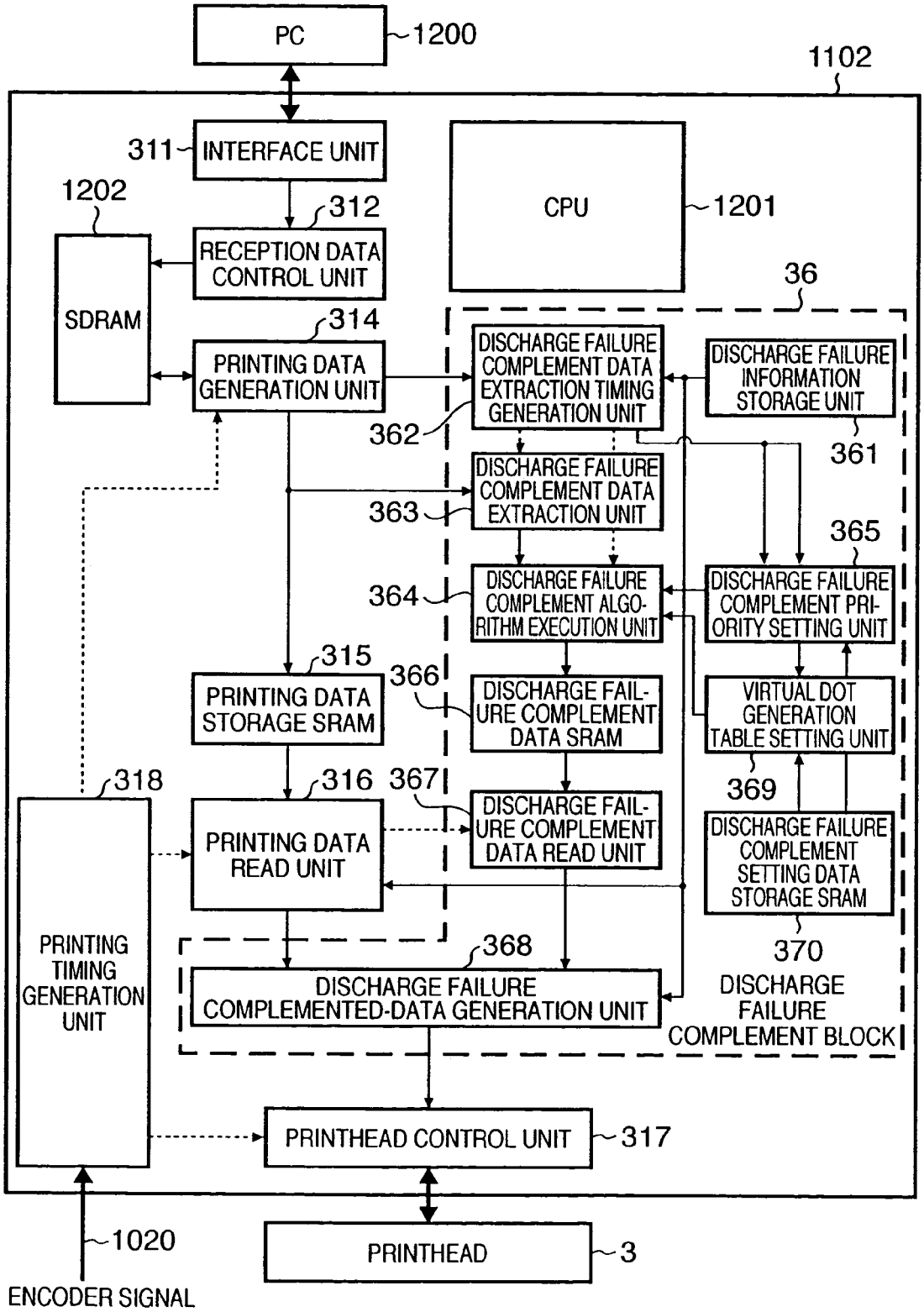
FIG. 13 is a block diagram showing the internal function configuration of an ASIC 1102 and its schematic data flow according to another embodiment.

FIG. 13 is a block diagram showing the internal function configuration of an ASIC 1102 and its schematic data flow according to the embodiment.

As is apparent from a comparison between FIGS. 13 and 9, their configurations are almost the same except for the presence of a discharge failure complement setting data storage SRAM 370.

The above-described embodiment does not consider strict specifications of a discharge failure complement priority setting unit 365, whereas this embodiment clearly defines them. In this embodiment, the discharge failure complement priority setting unit 365 and a virtual dot generation table setting unit 369 comprise only hardware configurations (=register sets) necessary to perform discharge failure complement for one nozzle array (corresponding to a nozzle array of one ink color).

Instead, the discharge failure complement setting data storage SRAM 370 stores discharge failure complement priority data and virtual dot generation tables corresponding to nozzle arrays of respective color inks. The discharge failure complement priority setting unit 365 and virtual dot generation table setting unit 369 receive a timing signal from a discharge failure complement data extraction timing generation unit 362, and read out necessary discharge failure complement priority data and a necessary virtual dot generation table from the discharge failure complement setting data storage SRAM 370 (these data must be set by a CPU 1201 in advance). The readout data are set in the internal register sets of the discharge failure complement priority setting unit 365 and virtual dot generation table setting unit 369.

In other words, the discharge failure complement data extraction timing generation unit 362, discharge failure complement priority setting unit 365, and virtual dot generation table setting unit 369 must function as follows.

The discharge failure complement data extraction timing generation unit 362 receives information from a discharge failure information storage unit 361, and specifies a position from which discharge failure complement data is extracted. At this time, the discharge failure complement data extraction timing generation unit 362 must recognize which color components of printing data the unit 362 monitors whether to extract discharge failure complement data (otherwise, printing data around discharge failure nozzles present at different positions in nozzle arrays corresponding to respective color inks cannot be extracted).

In outputting a timing signal, the discharge failure complement data extraction timing generation unit 362 can notify the discharge failure complement priority setting unit 365 and virtual dot generation table setting unit 369 by the signal, of the start of the discharge failure complement process and which of ink colors corresponds to a nozzle array subjected to discharge failure complement. By using the signal notification as a trigger, the discharge failure complement priority setting unit 365 and virtual dot generation table setting unit 369 read out the discharge failure complement priority and virtual dot generation table of a nozzle array in process from the discharge failure complement setting data storage SRAM 370.

In this way, the discharge failure complement setting data storage SRAM 370 stores discharge failure complement priority data and virtual dot generation table data for the number of nozzle arrays corresponding to respective color inks. The discharge failure complement priority setting unit 365 and virtual dot generation table setting unit 369 can tune discharge failure complement for respective ink colors (i.e., for respective nozzle arrays) by arranging only discharge failure complement register sets for one nozzle array (i.e., with a small hardware scale). With this arrangement, high quality printed image can be maintained.

In this case, the discharge failure complement setting data storage SRAM 370 is newly added. The discharge failure complement setting data storage SRAM 370 and discharge failure complement data SRAM 366 can use the same SRAM. An area where discharge failure complement setting data is stored and an area where discharge failure complement data is stored can be set in the same SRAM by using different address spaces. Even if two different types of data are stored in the same SRAM, the contents of the discharge failure complement setting data storage SRAM 370 is read out before the discharge failure complement process, and data is written in the discharge failure complement data SRAM 366 after the discharge failure complement process. Thus, read access and write access do not simultaneously occur. Therefore, the system process performance does not decrease even with a small hardware configuration.

Since the same SRAM plays two roles, i.e., the discharge failure complement setting data storage SRAM 370 and discharge failure complement data SRAM 366, the SRAM size (capacity) increases. However, the hardware scale can be greatly reduced in comparison with the arrangement of register sets by the number of nozzle arrays corresponding to respective color inks.

The above-described embodiment employs the discharge failure complement setting data storage SRAM in which data necessary for discharge failure complement is stored and read out, as needed. The embodiment can therefore prevent an increase in hardware and the negative effect to a printed image.

Further note that in the foregoing embodiments, although the description has been provided based on an assumption that a droplet discharged by the printhead is ink and that the liquid contained in the ink tank is ink, the contents are not limited to ink. For instance, the ink tank may contain processed liquid or the like, which is discharged to a printing medium in order to improve the fixability or water repellency of the printed image or to improve the image quality.

The above embodiment is not limited to the ink-jet printing system, but can be applied to any printing system. Of inkjet printing systems, a bubble-jet printing system which discharges ink by using an electrothermal transducer for generating thermal energy achieves high-density, high-definition printing. The bubble-jet printing system can preferably adopt the discharge failure complement method of complementing a discharge failure nozzle by using a plurality of nozzles around it.

In this case, as the pulse driving signal, signals disclosed in U.S. Pat. Nos. 4,463,359 and 4,345,262 are suitable. Note that further excellent printing can be performed by using the conditions described in U.S. Pat. No. 4,313,124 of the invention which relates to the temperature rise rate of the heat acting surface.

Furthermore, although each of the above-described embodiments adopts a serial-type printer which performs printing by scanning a printhead, a full-line type printer employing a printhead having a length corresponding to the width of a maximum printing medium may be adopted. For a full-line type printhead, either the arrangement which satisfies the full-line length by combining a plurality of printheads as described above or the arrangement as a single printhead obtained by forming printheads integrally can be used.

In addition, not only a cartridge type printhead in which an ink tank is integrally arranged on the printhead itself but also an exchangeable chip type printhead which can be electrically connected to the apparatus main unit and can receive an ink from the apparatus main unit upon being mounted on the apparatus main unit can be applicable to the present invention.

Further, the object of the present invention can be also achieved by providing a storage medium storing program codes for performing the aforesaid processes to a system or an apparatus, reading the program codes with a computer (e.g., CPU, MPU) of the system or apparatus from the storage medium, then executing the program.

In this case, the program codes read from the storage medium realize the functions according to the embodiments, and the storage medium storing the program codes constitutes the invention.

Further, the storage medium, such as a floppy disk, a hard disk, an optical disk, a magneto-optical disk, CD–ROM, CD–R, DVD–ROM, DVD–R, DVD–RW, DVD+RW, DVD-RAM, a magnetic tape, a non-volatile type memory card, and ROM can be used for providing the program codes.

Furthermore, besides aforesaid functions according to the above embodiments are realized by executing the program codes which are read by a computer, the present invention includes a case where an OS (operating system) or the like working on the computer performs a part or entire processes in accordance with designations of the program codes and realizes functions according to the above embodiments.

Furthermore, the present invention also includes a case where, after the program codes read from the storage medium are written in a function expansion card which is inserted into the computer or in a memory provided in a function expansion unit which is connected to the computer, CPU or the like contained in the function expansion card or unit performs a part or entire process in accordance with designations of the program codes and realizes functions of the above embodiments.

Furthermore, the above program may be supplied to a user through a communication network by means of Internet from a program provider.

As many apparently widely different embodiments of the present invention can be made without departing from the spirit and scope thereof, it is to be understood that the invention is not limited to the specific embodiments thereof except as defined in the appended claims.

CLAIM OF PRIORITY

This application claims priority under 35 U.S.C. 119 from Japanese Patent Application No. 2003-311342 filed on Sep. 3, 2003, the entire contents of which are incorporated herein by reference.

What is claimed is:

1. A printing apparatus which prints by using an inkjet printhead having a nozzle array formed from a plurality of nozzles for discharging ink, comprising:

scanning means for scanning the inkjet printhead in a direction different from a direction of the nozzle array;

virtual data generation means for generating virtual data over one or more dots in the scanning direction on the basis of printing data of a plurality of dots in the scanning direction that are printed by an ink discharge failure nozzle among the plurality of nozzles;

decision means for deciding a position subjected to complementary printing on the basis of a priority of a dot to be complementary-printed, the printing data of the plurality of dots, and the virtual data;

moving means for moving printing data and virtual data which actually cause ink discharge so as to print at the complementary printing position decided by said decision means;

corrected printing data generation means for generating corrected printing data to be actually printed by the inkjet printhead on the basis of the printing data and the virtual data which are moved by said moving means; and printing means for printing by driving the ink-jet printhead on the basis of the corrected printing data generated by said corrected printing data generation means, wherein the priority is obtained from the printing data of the plurality of dots and the virtual data, and the priority is a priority determined in a plurality of dots included in a predetermined adjacent area where the printing data of the plurality of dots and the virtual data are printed.

2. The apparatus according to claim 1, wherein said virtual data generation means has a table for generating the virtual data from the printing data of the plurality of dots.

3. The apparatus according to claim 1, wherein the predetermined adjacent area subjected to complementary printing includes an area surrounded by a plurality of dots in the scanning direction of the inkjet printhead and a plurality of dots in the direction of the nozzle array that surround the ink discharge failure nozzle.

4. The apparatus according to claim 1, wherein the inkjet printhead comprises a plurality of nozzle arrays in correspondence with a plurality of different inks.

5. The apparatus according to claim 1, further comprising priority decision means for deciding priorities of dots subjected to complementary printing among a plurality of dots within a predetermined adjacent area where the printing data of the plurality of dots and the virtual data are printed on the basis of the printing data of the plurality of dots and the virtual data, wherein said decision means decides a position where complementary printing should be performed, on the basis of the priority decided by said priority decision means.

6. The apparatus according to claim 5, wherein said priority decision means has priority data which defines priorities of dots subjected to complementary printing for dots corresponding to the printing data of the plurality of dots and the virtual data.

7. The apparatus according to claim 5, wherein said virtual data generation means, said priority decision means, said decision means, said moving means, and said corrected printing data generation means are formed by an ASIC.

8. The apparatus according to claim 7, further comprising a memory which stores priority data defining priorities of dots subjected to complementary printing, and tables for generating virtual data, the priority data and the tables corresponding to the plurality of nozzle arrays.

9. The apparatus according to claim 8, further comprising control means for reading out the priority data and the table that correspond to a nozzle array used to discharge ink, from said memory at each timing at which a nozzle array for discharging ink changes among the plurality of nozzle arrays.

10. A printing method capable of complementary printing when there is an ink discharge failure nozzle in an inkjet printhead having a nozzle array formed from a plurality of nozzles for discharging ink, comprising:

a virtual data generation step of generating virtual data over one or more dots in a scanning direction on the basis of printing data of a plurality of dots in a scanning direction of the inkjet printhead that are printed by an ink discharge failure nozzle among the plurality of nozzles;

a decision step of deciding a position subjected to complementary printing on the basis of a priority of a dot to be complementary-printed, the printing data of the plurality of dots, and the virtual data;

a moving step of moving printing data and virtual data which actually cause ink discharge so as to print at the complementary printing position decided at said decision step;

a corrected printing data generation step of generating corrected printing data to be actually printed by the inkjet printhead on the basis of the printing data and the virtual data which are moved at said moving step; and a printing step of printing by driving the ink-jet printhead on the basis of the corrected printing data generated at said corrected printing data generation step, wherein the priority is obtained from the printing data of the plurality of dots and the virtual data, and the priority is a priority determined in a plurality of dots included in a predetermined adjacent area where the printing data of the plurality of dots and the virtual data are printed.

11. The method according to claim 10, further comprising a priority decision step of deciding priorities of dots subjected to complementary printing among a plurality of dots within a predetermined adjacent area where the printing data of the plurality of dots and the virtual data are printed on the basis of the printing data of the plurality of dots and the virtual data, wherein, at said decision step, a position where complementary printing should be performed is decided on the basis of the priority decided by said priority decision means.

12. A program which allows a computer to execute steps of a printing method according to claim 10.

13. A computer-readable storage medium which stores a program according to claim 12.

* * * * *

UNITED STATES PATENT AND TRADEMARK OFFICE

CERTIFICATE OF CORRECTION

PATENT NO. : 7,192,112 B2
APPLICATION NO. : 10/929513
DATED : March 20, 2007
INVENTOR(S) : Nakanishi et al.

It is certified that error appears in the above-identified patent and that said Letters Patent is hereby corrected as shown below:

IN THE DRAWINGS:
Sheet No. 11, Figure 9, “ALGO” should read --ALGO- --.

COLUMN 1:
Line 14, “ink-jet” should read --inkjet--.

COLUMN 2:
Line 59, “printing” should read --the printing--.

COLUMN 4:
Line 37, “one more” should read --one or more--.

COLUMN 10:
Line 13, “to” should be deleted.

COLUMN 12:
Line 4, “medium P1” should read --medium P,--.

COLUMN 14:
Line 28, “but” should read --line--.

COLUMN 15:
Line 33, “along part” should read --along the part--.

COLUMN 16:
Line 8, “unit of byte).” should read --units of byte).--.
Line 61, “Part” should read --Parts--.

COLUMN 19:
Line 36, “data” should read --a data--.
Line 43, “process” should read --a process--.

COLUMN 22:
Line 6, “printing-data” should read --printing data--.
Line 25, “in unit” should read --in units--.
Line 37, “in unit” should read --in units--.

UNITED STATES PATENT AND TRADEMARK OFFICE

CERTIFICATE OF CORRECTION

PATENT NO. : 7,192,112 B2
APPLICATION NO. : 10/929513
DATED : March 20, 2007
INVENTOR(S) : Nakanishi et al.

It is certified that error appears in the above-identified patent and that said Letters Patent is hereby corrected as shown below:

COLUMN 23:
Line 45, “resulting” should read --resulting in--.

COLUMN 25:
Line 34, “ink-jet” should read --inkjet--.

COLUMN 26:
Line 16, “are realized” should read --being realized--.
Line 32, “Internet” should read --the Internet--.

COLUMN 27:
Line 4, “ink-jet” should read --inkjet--.

COLUMN 28:
Line 26, “ink-jet” should read --inkjet--.

Signed and Sealed this

Seventeenth Day of February, 2009

JOHN DOLL
*Acting Director of the United States Patent and Trademark Office*